US010881922B2

(12) United States Patent
Daraskavich et al.

(10) Patent No.: US 10,881,922 B2
(45) **Date of Patent: *Jan. 5, 2021**

(54) IRON-TYPE GOLF CLUB HEAD OR OTHER BALL STRIKING DEVICE

(71) Applicant: KARSTEN MANUFACTURING CORPORATION, Phoenix, AZ (US)

(72) Inventors: Matthew Robert Daraskavich, Trophy Club, TX (US); Jamil Jacaman, Fort Worth, TX (US); Matthew Brian Neeley, Fort Worth, TX (US); Michael R. Pinto, Fort Worth, TX (US); Nathaniel J. Radcliffe, Trophy Club, TX (US); Robert Horacek, Monson, MA (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/387,415

(22) Filed: Apr. 17, 2019

(65) Prior Publication Data

US 2019/0240545 A1 Aug. 8, 2019

Related U.S. Application Data

(63) Continuation of application No. 15/057,964, filed on Mar. 1, 2016, now Pat. No. 10,300,352.

(51) Int. Cl.

| | |
|---|---|
| ***A63B 53/04*** | (2015.01) |
| ***A63B 60/52*** | (2015.01) |
| ***A63B 60/02*** | (2015.01) |

(52) U.S. Cl.

CPC ..... *A63B 53/047* (2013.01); *A63B 53/0475* (2013.01); *A63B 60/02* (2015.10); *A63B 60/52* (2015.10); *A63B 53/0408* (2020.08); *A63B 53/0416* (2020.08); *A63B 53/0433* (2020.08); *A63B 53/0458* (2020.08);

(Continued)

(58) Field of Classification Search

USPC ..... 473/287–292, 324–350

See application file for complete search history.

(56) References Cited

U.S. PATENT DOCUMENTS

| | | | | |
|---|---|---|---|---|
| 2,328,583 A | | 9/1943 | Reach | |
| 5,050,879 A | * | 9/1991 | Sun | A63B 53/04 473/338 |
| 5,492,327 A | | 2/1996 | Biafore, Jr. | |

(Continued)

OTHER PUBLICATIONS

May 15, 2017—(WO) ISR & WO—App. No. PCT/Us17/020070 (018755.02407).

*Primary Examiner* — Nini F Legesse

(57) ABSTRACT

A ball striking device, such as an iron-type golf club head, includes a face having a ball striking surface and a body connected to the face. The body has a sole surface extending rearward from a leading edge of the face, and a toe surface extending rearward from a toe edge of the face. The sole surface configured to confront the playing surface. The iron-type club head may have an elongated channel extending from a heel side in the sole member to an end point within the toe surface. The elongated channel is recessed from the sole surface and toe surfaces and is spaced from the leading and toe edges of the face. The iron-type club head may also have a plurality of weighting elements that are adjustable by the user.

20 Claims, 20 Drawing Sheets

(52) U.S. Cl.
CPC ... *A63B 53/0462* (2020.08); *A63B 2053/0491* (2013.01); *A63B 2209/00* (2013.01)

(56) References Cited

U.S. PATENT DOCUMENTS

| | | | | |
|---|---|---|---|---|
| 5,564,705 | A | 10/1996 | Kobayashi et al. | |
| 6,042,486 | A | 3/2000 | Gallagher | |
| 6,290,609 | B1 | 9/2001 | Takeda | |
| 6,592,468 | B2 * | 7/2003 | Vincent | A63B 53/047 473/334 |
| 8,267,807 | B2 | 9/2012 | Takechi et al. | |
| 8,277,337 | B2 | 10/2012 | Shimazaki | |
| 8,376,878 | B2 | 2/2013 | Bennett et al. | |
| 8,430,763 | B2 * | 4/2013 | Beach | A63B 53/0466 473/307 |
| 8,454,453 | B2 | 6/2013 | Hettinger et al. | |
| 8,491,405 | B2 | 7/2013 | Jorgensen et al. | |
| 8,888,607 | B2 * | 11/2014 | Harbert | A63B 53/06 473/307 |
| 8,900,069 | B2 * | 12/2014 | Beach | A63B 53/0466 473/329 |
| 8,911,302 | B1 | 12/2014 | Ivanova et al. | |
| 9,044,653 | B2 * | 6/2015 | Wahl | A63B 53/0475 |
| 9,220,953 | B2 * | 12/2015 | Beach | A63B 60/00 |
| 9,937,395 | B2 | 4/2018 | Taylor et al. | |
| 10,300,352 | B2 * | 5/2019 | Daraskavich | A63B 53/047 |
| 2005/0227781 | A1 | 10/2005 | Huang et al. | |
| 2007/0026961 | A1 * | 2/2007 | Hou | A63B 53/0466 473/329 |
| 2012/0231897 | A1 * | 9/2012 | Hettinger | A63B 53/02 473/349 |
| 2013/0331201 | A1 * | 12/2013 | Wahl | A63B 53/0475 473/329 |

* cited by examiner

IRON-TYPE GOLF CLUB HEAD OR OTHER BALL STRIKING DEVICE

CROSS-REFERENCE TO RELATED APPLICATIONS

This is a continuation of U.S. patent application Ser. No. 15/057,964 filed on Mar. 1, 2016, all of which is incorporated fully herein by reference.

TECHNICAL FIELD

The disclosure relates generally to ball striking devices, such as iron-type golf clubs and heads. Certain aspects of this disclosure relate to iron-type golf clubs having features to increase the "hot zone" of higher coefficient of restitution on the club face.

BACKGROUND

Golf is enjoyed by a wide variety of players—players of different genders, and players of dramatically different ages and skill levels. Golf is somewhat unique in the sporting world in that such diverse collections of players can play together in golf outings or events, even in direct competition with one another (e.g., using handicapped scoring, different tee boxes, etc.), and still enjoy the golf outing or competition. These factors, together with increased golf programming on television (e.g., golf tournaments, golf news, golf history, and/or other golf programming) and the rise of well-known golf superstars, at least in part, have increased golfs popularity in recent years, both in the United States and across the world.

Golfers at all skill levels seek to improve their performance, lower their golf scores, and reach that next performance "level." Manufacturers of all types of golf equipment have responded to these demands, and recent years have seen dramatic changes and improvements in golf equipment. For example, a wide range of different golf ball models now are available, with some balls designed to fly farther and straighter, provide higher or flatter trajectory, provide more spin, control, and feel (particularly around the greens), etc.

Being the sole instrument that sets a golf ball in motion during play, the golf club also has been the subject of much technological research and advancement in recent years. For example, the market has seen improvements in golf club heads, shafts, and grips in recent years. Additionally, other technological advancements have been made in an effort to better match the various elements of the golf club and characteristics of a golf ball to a particular user's swing features or characteristics (e.g., club fitting technology, ball launch angle measurement technology, etc.).

Despite the various technological improvements, golf remains a difficult game to play at a high level. For a golf ball to reliably fly straight and in the desired direction, a golf club must meet the golf ball square (or substantially square) to the desired target path. Moreover, the golf club must meet the golf ball at or close to a desired location on the club head face (i.e., on or near a "desired" or "optimal" ball contact location) to reliably fly straight, in the desired direction, and for a desired distance. Off-center hits may tend to "twist" the club face when it contacts the ball, thereby sending the ball in the wrong direction, imparting undesired hook or slice spin, and/or robbing the shot of distance. Club face/ball contact that deviates from squared contact and/or is located away from the club's desired ball contact location, even by a relatively minor amount, also can launch the golf ball in the wrong direction, often with undesired hook or slice spin, and/or can rob the shot of distance. When the club face is not square at the point of engagement, the golf ball may fly in an unintended direction and/or may follow a route that curves left or right, ball flights that are often referred to as "pulls," "pushes," "draws," "fades," "hooks," or "slices," or may exhibit more boring or climbing trajectories. Accordingly, club head features that can help a user keep the club face square with the ball would tend to help the ball fly straighter and truer, in the desired direction, and often with improved and/or reliable distance.

The energy or velocity transferred to the ball by a golf club also may be related, at least in part, to the "coefficient of restitution" (or "COR") of the club face at the point of contact. The maximum COR for golf club heads is currently limited by the USGA at 0.830. Generally, a club head will have an area of highest response relative to other areas of the face, such as having the highest COR, which imparts the greatest energy and velocity to the ball, and this area is typically positioned at the desired ball contact location, usually at the center of the face or in line with the center of gravity of the club head. Iron-type golf clubs are often used to hit a ball sitting directly on the playing surface, and thus, frequently impact the ball at locations below the center of the face. Typically, a golfer desires for an iron-type golf club to go a specific distance, while a wood-type club is designed for maximum distance. Occasionally, a golfer may mishit a ball with an iron-type golf club away from the center of the face resulting in a degradation of launch conditions, such as ball speed, launch angle, and spin rate, caused by an impact away from the center of gravity and in an area of the face that may not have the same responsiveness as the center of the face. The resulting degradation of launch conditions causes the golf shot to lose distance and miss the intended target. A desired feature of an iron-type golf club is to have mishits launch with a minimum amount of ball speed loss on impacts towards the heel or toe when compared to an impact on near the center of the face. Accordingly, an iron-type golf club may benefit from a design that assists in imparting greater ball speed to a golf ball that is mishit away from the center of the face.

The present devices are provided to address the problems discussed above and other problems, and to provide advantages and aspects not provided by prior ball striking devices of this type. A full discussion of the features and advantages of the present disclosure is deferred to the following detailed description, which proceeds with reference to the accompanying drawings.

SUMMARY

The following presents a general summary of aspects of the disclosure in order to provide a basic understanding of the disclosure and various features of it. This summary is not intended to limit the scope of the disclosure in any way, but it simply provides a general overview and context for the more detailed description that follows.

According to aspects of this disclosure, an iron-type golf club head may comprise, a face comprising a substantially flat ball striking surface, a rear surface opposite the ball striking surface, a body comprising a hosel, a heel side, a toe side, a toe surface, a top surface, and a sole surface and an elongated channel located in the sole surface being spaced from a leading edge and recessed from the sole surface. The elongated channel may have a depth of recession from the sole surface and a length defined between a first end located near the heel side of the sole surface and extending toward the toe side to a second end. The second end of the elongated channel may be located on the toe surface, where the second end of the elongated channel may be located within a range of 40 percent to 70 percent of a maximum club head height. Additionally, the elongated channel may be generally parallel to the leading edge of the face. The iron-type golf club head may further comprise a plurality of weighting elements positioned on the sole surface and the toe surface where at least one of the plurality of weighting elements may be oriented along an axis substantially perpendicular to the sole surface. In addition, at least one of the plurality of weighting elements may be oriented along an axis substantially perpendicular to the toe surface. The plurality of weighting elements may comprise at least one weighting element positioned on the toe surface, at least one weighting element positioned near a center of the sole surface, and at least one weighting element positioned near the heel side of the sole surface. Also, the plurality of weighting elements may comprise a first weighting element made of a first material and a second weighting element made of a second material. The iron-type golf club head may contain contains a hollow interior and may have an overall sole thickness within a range between 13 mm and 31 mm.

Another aspect of this disclosure may relate to an iron-type golf club head comprising a face comprising a substantially flat ball striking surface, a body comprising a hosel, a heel side, a toe side, a toe surface, a top surface, and a sole surface, and an elongated channel located in the sole surface and the toe surface and being spaced from a leading edge. The elongated channel may be recessed from the sole surface and the toe surface, where the elongated channel may have a depth of recession from the sole surface and the toe surface, and a length defined between a first end located in the heel side and a second end located on the toe surface. Additionally, a plurality of weighting elements may be positioned on the sole surface and the toe surface with at least one of the plurality of weighting elements oriented along an axis substantially perpendicular to the sole surface. The iron-type golf club head may have a hollow interior and an overall sole thickness within a range between 13 mm and 31 mm.

Yet another aspect of this disclosure relates to an iron-type golf club head where at least one of the plurality of weighting elements may be oriented along an axis substantially perpendicular to the toe surface. The plurality of weighting elements may comprise a first weighting element made of a first material and a second weighting element made of a second material. The plurality of weighting elements may further comprise a third weighting element wherein the first weighting element, the second weighting element, and the third weighting element may be cylindrically shaped and may have the same volume.

Still another aspect of this disclosure relates to an iron-type golf club head comprising a face comprising a substantially flat ball striking surface, a body comprising a hosel, a heel side, a toe side, a toe surface, a top surface, and a sole surface, a rear body member enclosing a hollow interior, a first weighting element, a second weighting element, a third weighting element, and an elongated channel located in the sole surface and the toe surface and being spaced from a leading edge. The elongated channel being recessed from the sole surface and the toe surface, where the elongated channel may have a depth of recession from the sole surface and the toe surface and a length defined between a first end located in the heel side and a second end located on the toe surface. The second end of the elongated channel may be located within a range of 40 percent to 70 percent of a maximum club head height. Lastly, the iron-type golf club head may have an overall sole thickness within a range between 13 mm and 31 mm.

Another aspect of this disclosure relates to an iron-type golf club head where the plurality of weighting elements may be removable, and the first weighting element may have a first axis oriented substantially perpendicular to the toe surface, the second weighting element may have a second axis oriented substantially perpendicular to the sole surface, and the third weighting element may have a third axis oriented substantially perpendicular to the sole surface. The first weighting element may be made of a first material and the second weighting element may be made of a second material, and wherein the first material may be different than the second material. In addition, the first weighting element, the second weighting element, and the third weighting element are cylindrically shaped and have the same volume. Furthermore, the rear body member may be made of a carbon fiber reinforced polymer.

BRIEF DESCRIPTION OF THE DRAWINGS

To allow for a more full understanding of the present disclosure, it will now be described by way of example, with reference to the accompanying drawings in which.

Figure 1:
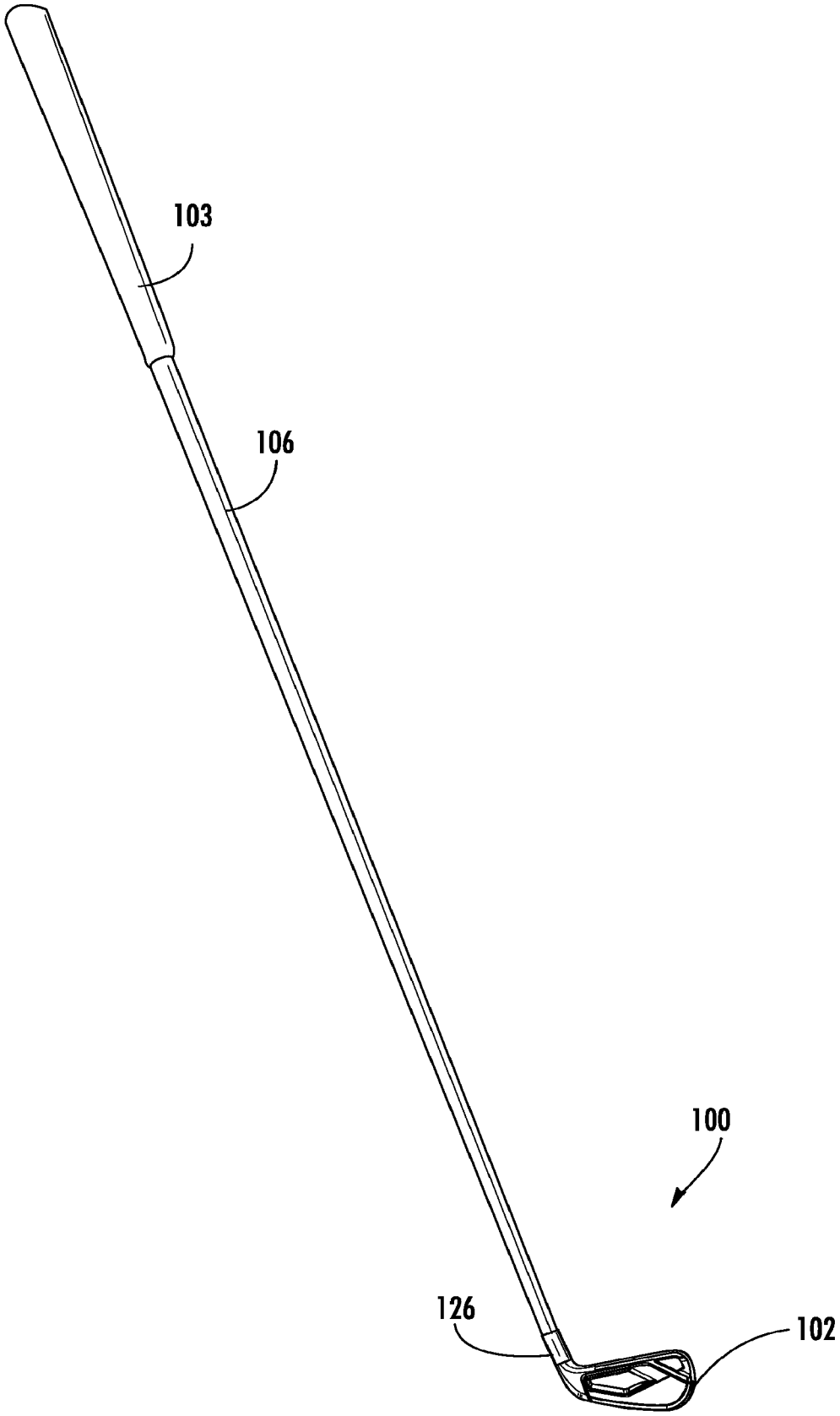
FIG. 1 is a perspective view of an illustrative embodiment of an iron-type ball striking device according to aspects of the present disclosure.

The reader is advised that the attached drawings are not necessarily drawn to scale.

DETAILED DESCRIPTION

In the following description of various example structures according to the disclosure, reference is made to the accompanying drawings, which form a part hereof, and in which are shown by way of illustration various example devices, systems, and environments in which aspects of the disclosure may be practiced. It is to be understood that other specific arrangements of parts, example devices, systems, and environments may be utilized and structural and functional modifications may be made without departing from the scope of the present disclosure. Also, while the terms "top," "bottom," "front," "back," "side," "rear," and the like may be used in this specification to describe various example features and elements of the disclosure, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this disclosure.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft or handle member, and it may be attached to the shaft or handle in some manner.

The terms "shaft" and "handle" are used synonymously and interchangeably in this specification, and they include the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, and welding (including brazing, soldering, or the like), where separation of the joined pieces cannot be accomplished without structural damage thereto. Pieces joined in this manner are considered "integrally joined."

"Generally parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

In general, aspects of this disclosure relate to ball striking devices, such as golf club heads, and golf clubs. Such ball striking devices, according to at least some examples of the disclosure, may include a ball striking head and a ball striking surface. In the case of a golf club, the ball striking surface is a substantially flat surface on one face of the ball striking head. Some more specific aspects of this disclosure relate to iron-type golf clubs and golf club heads, including long irons, short irons, wedges, etc. Alternately, some aspects of this disclosure may be practiced with hybrid clubs, chippers, and the like, or wood-type golf clubs and the like.

According to various aspects of this disclosure, the ball striking device may be formed of one or more of a variety of materials, such as metals (including metal alloys), ceramics, polymers, composites (including fiber-reinforced composites), and wood, and may be formed in one of a variety of configurations, without departing from the scope of the disclosure. In one illustrative embodiment, some or all components of the head, including the face and at least a portion of the body of the head, are made of metal. It is understood that the head may contain components made of several different materials, including carbon-fiber and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques.

The various figures in this application illustrate examples of ball striking devices according to this disclosure. When the same reference number appears in more than one drawing, that reference number is used consistently in this specification and the drawings refer to the same or similar parts throughout.

At least some examples of ball striking devices according to this disclosure relate to golf club head structures, including heads for wood-type golf clubs, such as drivers, as well as long iron clubs (e.g., driving irons, zero irons through five irons), short iron clubs (e.g., six irons through pitching wedges, as well as sand wedges, lob wedges, gap wedges, and/or other wedges), and hybrid clubs. Such devices may include a one-piece construction or a multiple-piece construction. Example structures of ball striking devices according to this disclosure will be described in detail below in conjunction with FIG. 1, which illustrates an example of a ball striking device 100 in the form of an iron-type golf club, in accordance with at least some examples of this disclosure.

FIG. 1 illustrates a ball striking device 100 in the form of a golf iron, in accordance with at least some examples of this disclosure, and illustrative embodiments of heads 102, et seq., of ball striking devices 100 of this type are shown in FIGS. 2-26. The golf club head 102 of FIG. 1 may be representative of any iron-type golf club head in accordance with examples of the present disclosure. As shown in FIG. 1, the ball striking device 100 includes a ball striking head 102, a shaft 106 connected to the ball striking head 102, and a grip member 103 engaged with the shaft 106. The ball striking head 102 of the ball striking device 100 of FIG. 1 has a face or face plate 110 connected to a body 108, with a hosel 126. Any desired hosel and/or head/shaft interconnection structure may be used without departing from this disclosure, including conventional hosel or other head/shaft interconnection structures as are known and used in the art, or an adjustable, releasable, and/or interchangeable hosel or other head/shaft interconnection structure such as those shown and described in U.S. Pat. No. 6,890,269 dated May 10, 2005, in the name of Bruce D. Burrows, U.S. Pat. No. 7,722,474, filed on Jul. 6, 2007, in the name of James S. Thomas, et al., U.S. Pat. No. 7,722,475, filed on Jul. 6, 2007, in the name of James S. Thomas, et al., U.S. Pat. No. 7,704,156, filed on Jul. 6, 2007, in the name of John Thomas Stites, et al., U.S. Published Patent Application No. 2009/0062029, filed on Aug. 28, 2007, in the name of John Thomas Stites, et al., and U.S. Pat. No. 9,050,507, filed on Oct. 31, 2012, in the name of Robert Boyd, et al., all of which are incorporated herein by reference in their entireties.

Any desired materials also may be used for the shaft 106, including conventional materials that are known and/or used in the art, such as steel, graphite based materials, polymers, composite materials, combinations of these materials, etc. Optionally, if necessary or desired, the shaft 106 may be modified (e.g., in size, shape, etc.) to accommodate releasable club head/shaft connection parts. The grip member 103 may provide a golfer with a slip resistant surface with which to grasp golf club and may be engaged with the shaft 106 to in any desired manner, including in conventional manners that are known and/or used in the art (e.g., via cements or adhesives, via mechanical connections, etc.). Any desired materials may be used for the grip member 103, including conventional materials that are known and/or used in the art, such as rubber, polymeric materials, cork, rubber or polymeric materials with cord or other fabric elements embedded therein, cloth or fabric, tape, etc.

Figure 2:
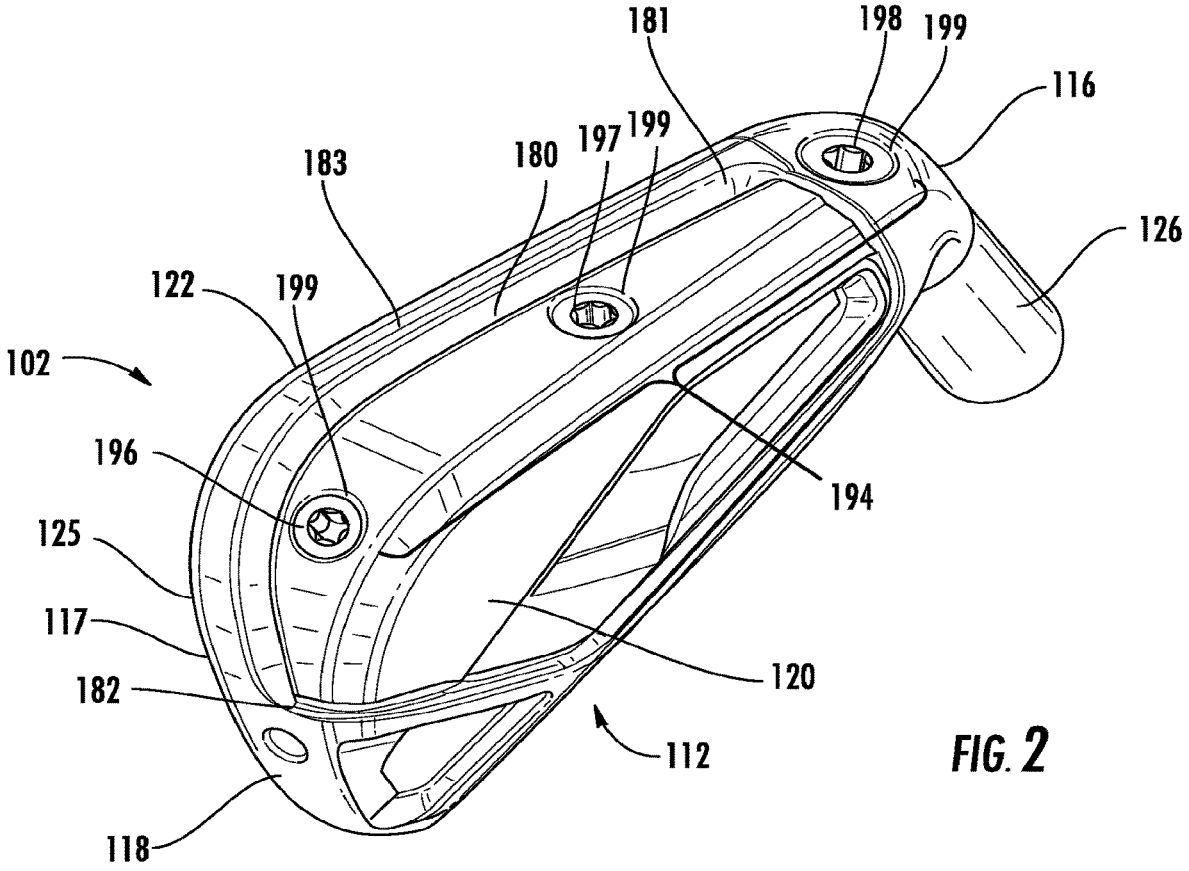
FIG. 2 is a perspective view of an illustrative embodiment of a club head of an iron-type ball striking device.
Figure 3:
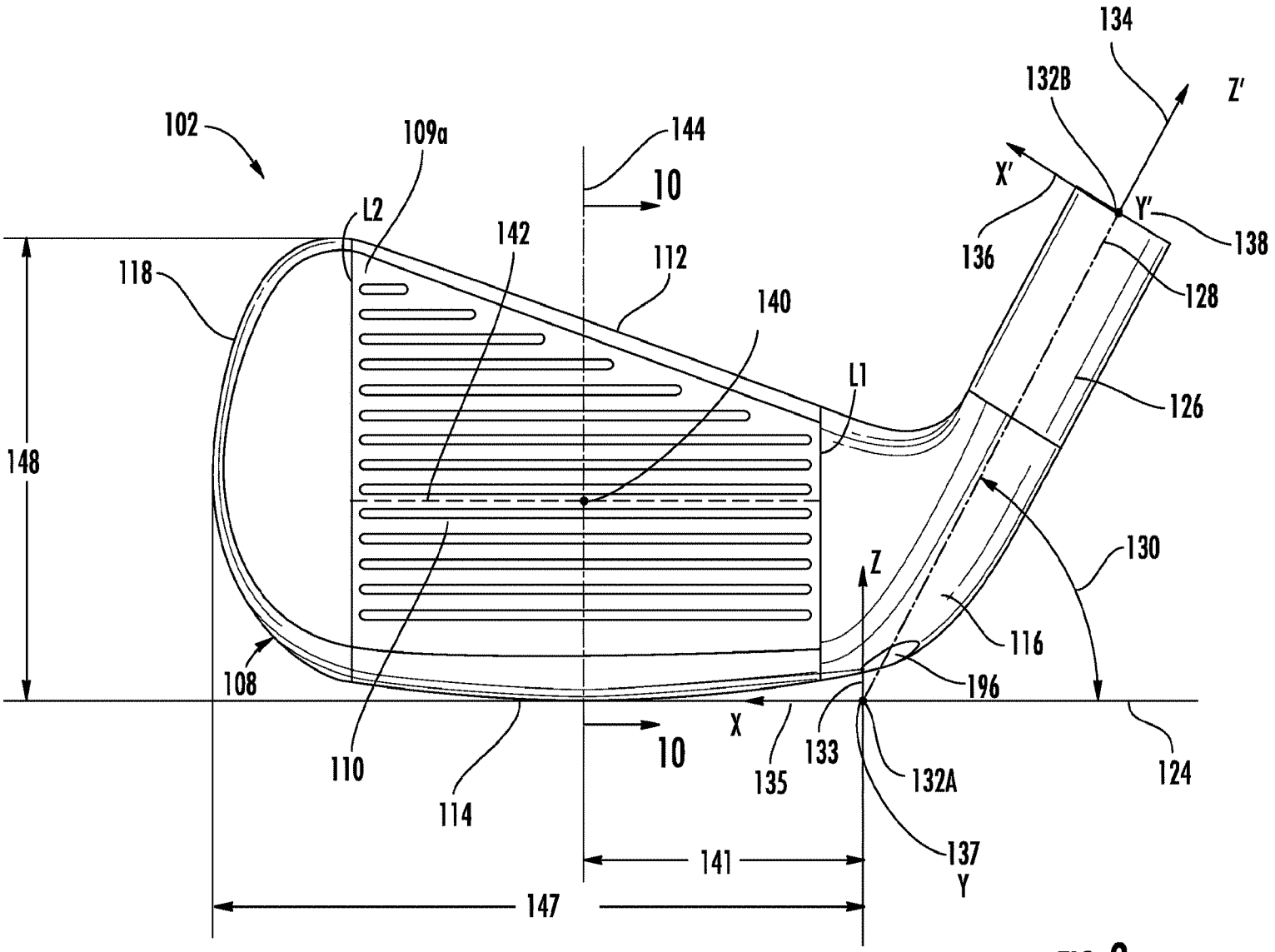
FIG. 3 is a front view of a club head of the iron-type ball striking device of FIG. 2.

FIG. 2 shows a perspective view of an embodiment of an iron-type golf club head 102. FIG. 3 shows a front view of the club head 102 of FIG. 2. An iron-type club head 102 may have a face or face plate 110 having a ball striking surface 109 and a rear surface 111 opposite the ball striking surface 109, a club head body 108 having a top surface 112, a sole surface 114, a heel side 116, a toe side 117, a toe surface 118 and a rear surface 120. The top surface 112 may be defined as the upper portion of the club head 102. The sole surface 114 may be defined as the bottom or underside portion of the club head 102, and is generally opposite the top surface 112. The sole surface 114 extends rearward from a leading edge 122 of the face 110. The sole surface 114 may include an area on the club head 102 that rests on the ground when a golfer soles the golf club 100. The heel side 116 may be the part of the club head 102 nearer to and including a hosel 126. The toe side 117 may be the area of the golf club 100 that is the farthest from the shaft 106. The toe surface 118 may be the surface connecting the top surface 112 to the sole surface 114, and extends rearward from a toe edge 125 of the face 110. The rear surface 120 of the club head 102 is generally opposite the face plate 110. The shaft 106 attaches to the club head 102 at the heel 116 via a hosel 126. An elongated channel 180 may be located on the club head 102 such that the elongated channel 180 may have a first end 181 located on the heel side 116 of the sole 118 and a second end 182 located on the toe surface 118 of the iron-type club head 102. A transition surface 183 may be located on the sole 114 between the ball striking surface 109 and the elongated channel 180.

Generally, all iron club heads 102 include various parts. FIG. 3 illustrates various parts of the golf club head 102 as will be referenced throughout the remainder of this application (as referenced from USGA Rules of Golf). The iron-type club head 102 has a face 110 having a ball striking surface 109, a top surface 112, a sole 114, a heel 116, a toe side 117, a toe surface 118, and a rear surface 120. The sole 114 may generally rest on a ground plane 124, wherein the ground plane 124 is a horizontal plane tangent with the bottom of the club head 102. The shaft 106 has a center axis (not shown). The hosel 126 may have a bore for receiving the shaft 106, or a shaft adapter (not shown). The hosel bore has a center axis or a hosel axis 128. If the shaft 106 is inserted and attached directly to hosel bore, the hosel axis 128 may be substantially coincident with shaft axis. For club configurations including a shaft adapter, the shaft 106 may be received in a shaft adapter bore. The shaft adapter bore may have a center axis or shaft adapter axis, which may be substantially coincident with shaft axis. The shaft adapter axis may be offset angularly and/or linearly from the hosel axis 128 to permit adjustment of club parameters via rotation of the shaft adapter with respect to club head 102, as is known by persons skilled in the art.

According to aspects of this disclosure, a golf club 100 may be oriented in a reference position. In the reference position, the golf club 100 may include a number of parameters or characteristics that may include, but are not limited to: a face center location 140, a loft angle 150, a face angle 160, a lie angle 130, and a center of gravity location 170. Parameters or characteristics as well as methods and procedures for measuring them will be described and detailed below.

As illustrated in FIG. 3, a lie angle 130 is defined as the angle formed between the shaft axis or hosel axis 128 and a horizontal plane contacting the sole 114, which may be the ground plane 124 when the iron is positioned such that the plurality of scorelines or grooves 121 on the face are parallel to the ground plane 124.

FIG. 3 illustrates the face center location 140 on a club head 102. The face center location 140 is determined using Unites States Golf Association (USGA) standard measuring procedures and methods. For example, the current USGA procedure requires finding the center point along a horizontal line 142 along the ball striking surface 109 until the heel side 116 and the toe side 117 measurements from the edges of the roughened area of the ball striking surface 109 of the club head 102 are equidistant defining a face center plane 144 defined as a vertical plane through the face center location 140. The face center location 140 is then defined along the face center plane 144 when the top surface 112 and the sole surface 114 measurements at the edges of the ball striking surface 109 of the club head 102 are also equidistant.

An origin point 132 may be defined on the golf club 100 or golf club head 102, or a point defined in relation to certain elements of the club or head. Various other points, such as the center of gravity, sole contact, and face center location 140, may be described and/or measured in relation to the origin point 132. FIG. 3 illustrates two different examples of where the origin point 132 may be located. A first location 132A, defined as a ground origin point 132A, is generally located at the ground plane 124. The ground origin point 132A is defined as the point at which the ground plane 124 and the hosel axis 128 intersect. The second location 132B, defined as the hosel origin point 132B, is generally located on the hosel 126. The hosel origin point 132B is located on the hosel axis 128 and coincident with an uppermost edge 127 of the hosel 126. Either location for the origin point 132 may be utilized without departing from this disclosure. Additionally, other locations for the origin point 132 may be utilized without departing from this disclosure. Throughout the remainder of this application, the ground origin point 132A will be utilized for all reference locations, tolerances, and calculations.

As illustrated in FIG. 3, a primary coordinate system may be defined on the origin point 132A, e.g., the origin point 132A has an X axis 135 parallel to the ground plane 124 and generally parallel to the leading edge 122 of the golf club head 102, a Y axis 137 perpendicular to the X axis 135 and oriented away from the rear surface of the club head 120, and a Z axis 133 perpendicular to the ground plane 124.

Additionally, as illustrated in FIG. 3, a secondary coordinate system may be defined on the origin point 132B, e.g., with a Z' axis 134 extending along the direction of the hosel axis 128, an X' axis 136 parallel with the vertical plane and normal to the Z' axis, and a Y' axis 138 normal to the X' and Z' axes.

Figure 4:
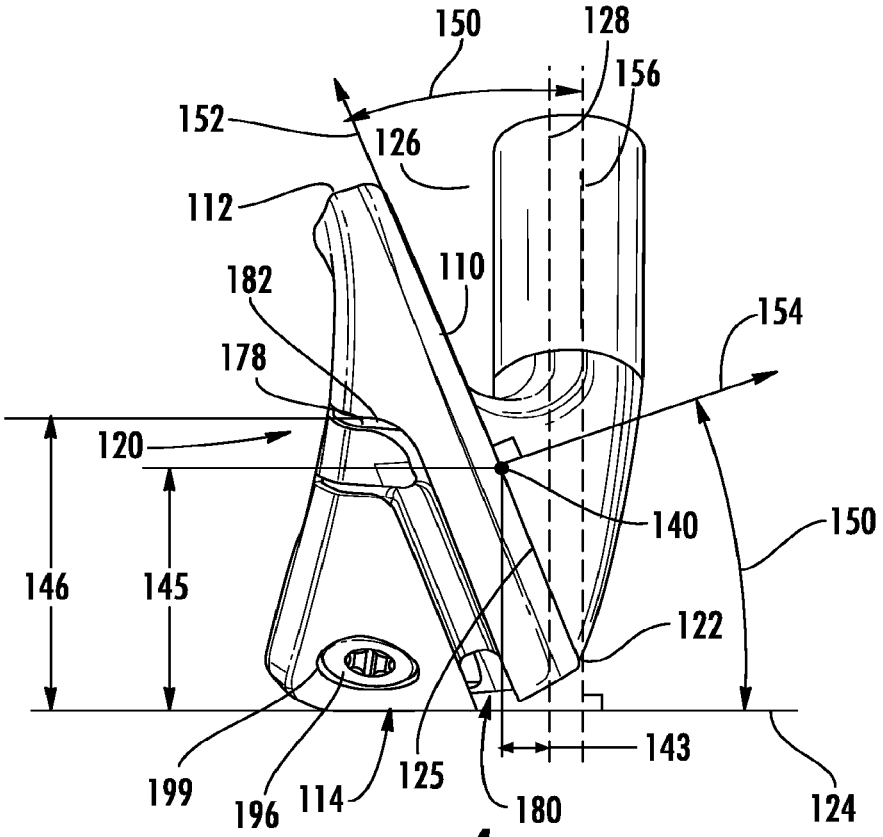
FIG. 4 is a side view of the club head of FIG. 2.

FIG. 4 illustrates an example of a loft angle 150 and a leading edge 122 of the golf club head 102. An iron-type club head 102 may have a ball striking surface 109 that is substantially planar. The loft angle 150 is defined as a measurement between an axis normal 152 or perpendicular to a face center axis 154 and an axis normal 156 or perpendicular to the ground plane 124. The face center axis 154 is defined as the axis from the face center location 140 and normal to the face. Alternatively, the loft angle 150 may be defined as a measurement between the face center axis 154 and the ground plane 124. It is recognized that each of these loft angle 150 definitions may yield a similar or exactly the same loft angle measurement. The leading edge 122 is the forward most surface connecting the sole 114 and the face plate 110. The leading edge 122 may be a constant radius or may have a curvature that changes along the heel to the toe of the golf club head.

Additionally, FIGS. 3 and 4 show the face center location 140 may be defined from the ground origin point 132A and the ground plane coordinate system, where CFX 141 is the distance along the X axis 135 from the origin point 132A, CFY 143 is the distance along the Y-axis 137, and CFZ 145 is distance along the Z-axis 133. Also, the head length 147 of the golf club head can be defined from the origin point 132A as measured along X-axis 135 to the furthest extent of the toe surface 118 of the golf club head 102. A maximum club head height 148 may be defined as a distance from the ground plane 124 to the furthest extent of the top surface 112.

Additionally, the club head 102 may have a sole thickness, or sole width, may be defined at a location on the heel, the center and toe. The heel sole thickness, Su, may be measured at the end of the scorelines in the heel side of the ball striking surface 109, the center sole thickness, $S_C$, may be measured at the face center location 140 of the ball striking surface 109, and a toe sole thickness, $S_T$, may be measured at the end of the scorelines on the toe side of the ball striking surface 109. The sole thickness at each location may be measured perpendicular from the ball striking face 109 to a rear edge of the sole surface 114 as shown in FIG. 4. The heel sole thickness, $S_H$, may be approximately 18.5 mm or within a range of 13 mm to 23.5 mm. The center sole thickness, $S_C$, may be approximately 24 mm or within a range of 19 mm to 29 mm, and the toe sole thickness, $S_T$, may be approximately 26 mm or within a range of 21 mm to 31 mm. The overall sole thickness may be within a range of 13 mm to 31 mm.

Figure 5:
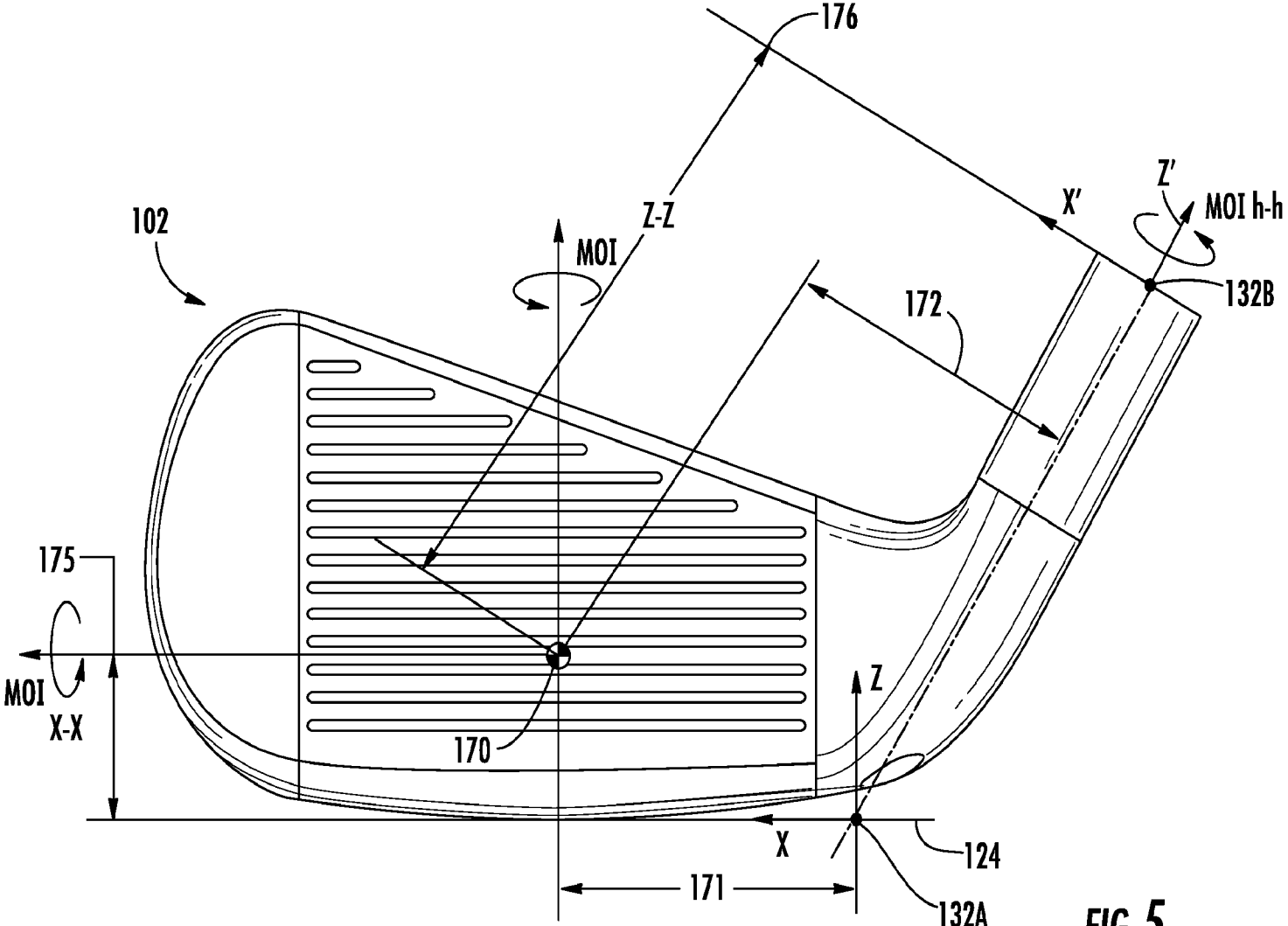
FIG. 5 is a front view of the club head of FIG. 2.
Figure 6:
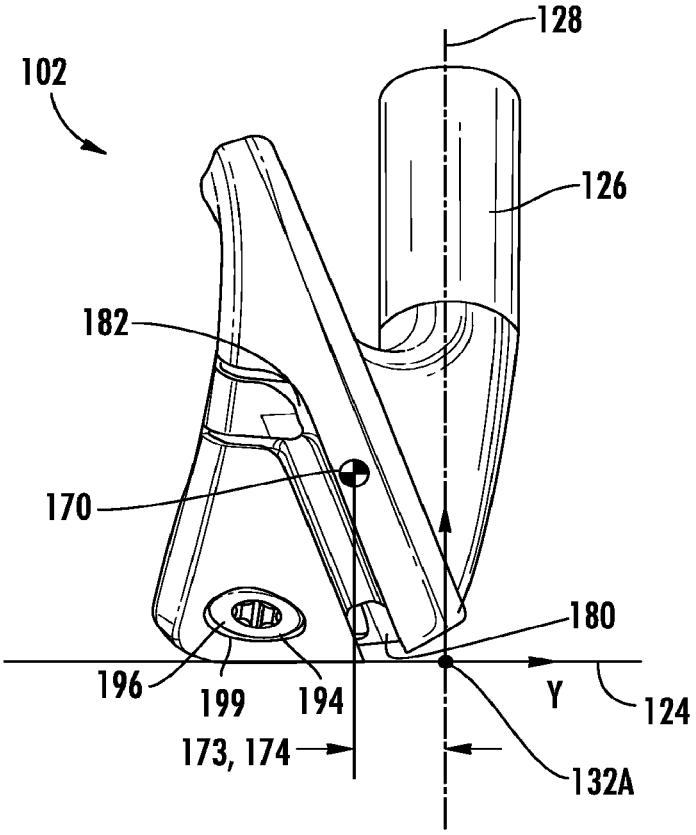
FIG. 6 is a side view of the club head of FIG. 2.

FIGS. 5 and 6 illustrate an example of a center of gravity location 170 as a specified parameter of the club head 102. The center of gravity location 170 of the club head 102 may be determined using various methods and procedures known and used in the art. The club head center of gravity location 170 is provided with reference to its position from the origin point 132A. As illustrated in FIGS. 5 and 6, the center of gravity location 170 is defined by a distance from the origin point 132A along the X axis 135 named CGX 171, Y axis 137 named CGY 173, and Z axis 133 named CGZ 175. The center of gravity 170 of the golf club head 102 may be provided with reference to its position from the hosel origin point 132B. The center of gravity location 170 may also be defined by a distance from the hosel origin point 132B along the X' axis 136, named ΔX 172, the Y' axis 138, named ΔY 174, and the Z' axis 134, named ΔZ 176.

The moment of inertia is a club head 102 property whose importance is well known to one skilled in the art. There are three moment of inertia properties that this application may reference. As FIG. 5 illustrates the MOIx-x, which is the moment of inertia of an axis through the center of gravity 170 of the club head 102 around an axis parallel to the X-axis 135 of the origin coordinate system. Similarly, the MOIz-z is the moment of inertia of an axis through the center of gravity 170 around an axis parallel to the Z-axis 133 as illustrated in FIG. 5. Lastly, the MOI h-h, is the moment of inertia around the shaft axis or Z'-axis 134 as illustrated in FIG. 5. The MOI h-h is important in looking at how the club head 102 may resist the golfer's ability to close the club head 102 during the swing.

Figure 7:
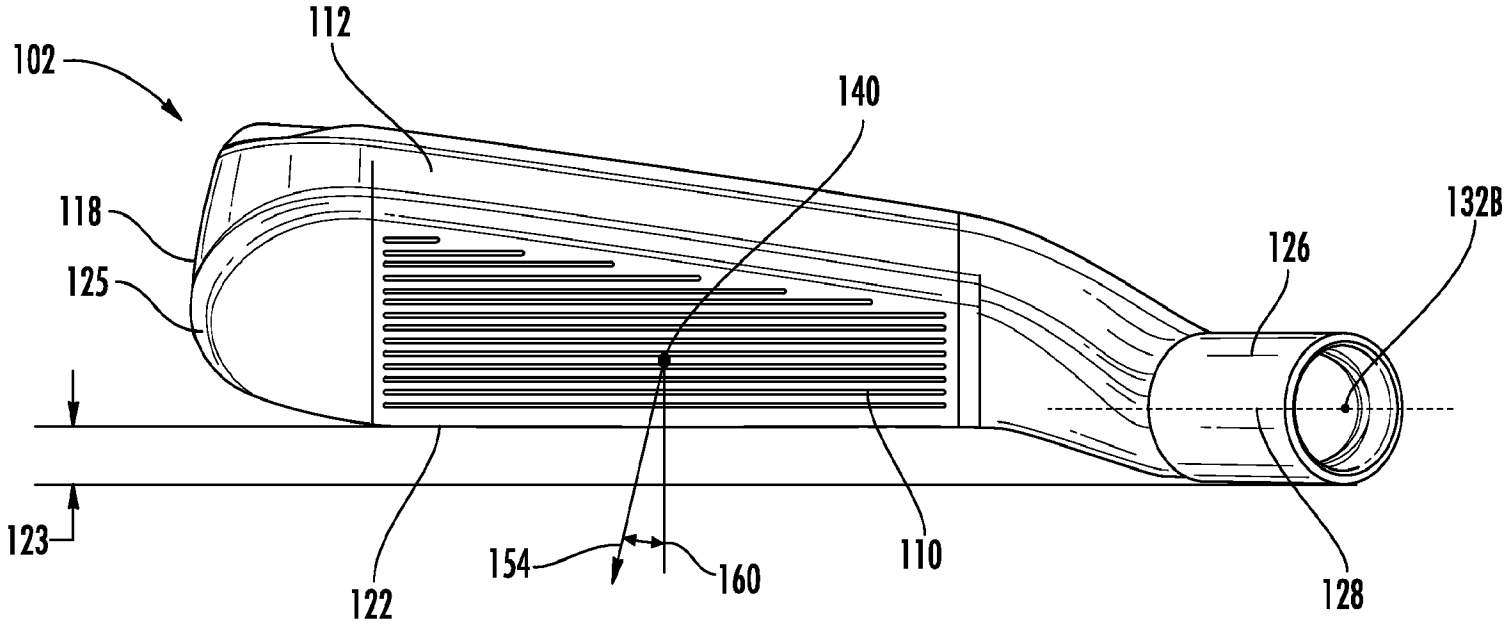
FIG. 7 is a top view of the club head of FIG. 2.
Figure 8:
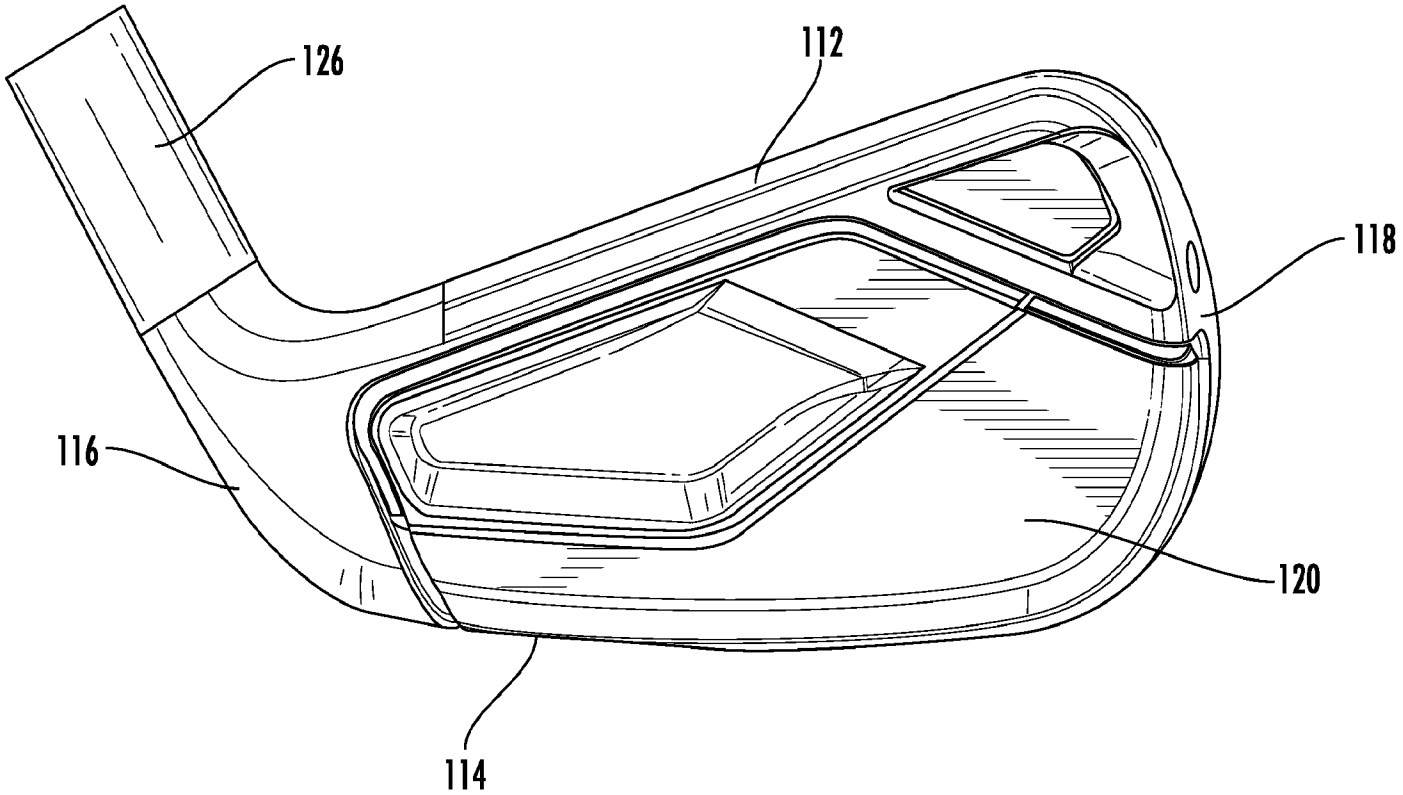
FIG. 8 is a rear view of the club head of FIG. 2.

FIG. 7 illustrates an example of a face angle 160 of a golf club head 102. As illustrated in FIG. 7, the face angle 160 is measured by utilizing the face center axis 154 and a right plane 162 (a plane perpendicular to the X axis 135). Typically, an iron-type golf club head may have a face angle 160 of zero degrees. Additionally, the offset 123 of the club head may be defined a distance from the forward edge of the top of the hosel 126 to the forward most point of the leading edge 122 in the Y-axis 137 direction.

FIGS. 3-7 illustrate a club head 102 oriented in a reference position. In the reference position, the hosel axis 128 or shaft axis lies in a vertical plane as shown in FIG. 4. As illustrated in FIG. 3, the hosel axis 128 may be oriented at a lie angle 130. The lie angle selected for the reference position may be the golf club 100 manufacturer's specified lie angle. If a specified lie angle is not available from the manufacturer, a lie angle can be determined using the parallel scoreline method described herein. Furthermore, for the reference position, as illustrated in FIG. 3, the ball striking surface 109 may be oriented at a loft angle 150. The loft angle selected for the reference position may be the golf club manufacturer's specified loft angle. Table 1, below, provides typical loft and lie angles for various iron-type golf club heads in accordance with an embodiment of this disclosure.

TABLE 1

Example Loft and Lie Angles for Iron-Type Club Heads

| Iron-Type Golf Club Head Number | Typical Loft Angle (Degrees) | Typical Lie Angle (Degrees) |
|---|---|---|
| #3 | 19.0 | 59.0 |
| #4 | 21.0 | 60.0 |
| #5 | 24.0 | 61.0 |
| #6 | 28.0 | 62.0 |
| #7 | 32.0 | 62.5 |

TABLE 1-continued

Example Loft and Lie Angles for Iron-Type Club Heads

| Iron-Type Golf Club Head Number | Typical Loft Angle (Degrees) | Typical Lie Angle (Degrees) |
|---|---|---|
| #8 | 36.0 | 63.0 |
| #9 | 40.0 | 63.5 |
| PW | 44.0 | 64.0 |
| AW | 49.0 | 64.0 |

As described in Table 1, the club head 102 as shown in FIGS. 1-26 illustrates an iron-type golf club head. The club head 102 may be any iron-type club head with a loft angle 150 range between 20 degrees to 50 degrees, or a loft angle 150 between 16 degrees and 65 degrees. As such the club head 102 may be used on all of the iron-type club heads within a set of golf clubs. Alternatively, the golf club head 102 may be used with the "long to mid" irons within a set of golf clubs, where getting the maximum distance is at a premium. Thus, the iron-type club head 102 may have a loft angle 150 range of 16 degrees to 36 degrees, or a loft angle 150 within a range of 18 degrees to 34 degrees, or a loft angle 150 within a range of 18 degrees to 28 degrees, or a loft angle 150 within a range of 18 degrees to 25 degrees.

The club head 102 may have a weight within a range of 220 grams to 305 grams, or within a range of 235 grams to 275 grams, or within a range of 240 grams to 270 grams. The club head 102 may have the center of gravity CGX positioned at approximately the center of face location in the X-axis direction, or the center of gravity in the X direction may be positioned within a range of 1 mm of the face center location 140 towards the toe side 117 and 2 mm towards the heel side 116 of the face center location 140, or within a range of 1 mm of the face center location 140 towards the toe side 118 and 4 mm towards the heel side 116 of the face center location 140. CGY may be within a range of 8 mm to 14 mm, or within a range of 6 mm to 16 mm. CGZ may be in a range of 20 mm to 22 mm, or within a range of 18 to 24 mm. The club head 102 may have a MOIx-x within a range of 520 $g*cm^2$ to 700 $g*cm^2$, or within a range of 500 $g*cm^2$ to 750 $g*cm^2$. The club head 102 may have a MOIz-z of approximately 2750 $g*cm^2$ to 3100 $g*cm^2$, or within a range of 2400 $g*cm^2$ to 3300 $g*cm^2$ and an MOI h-h of approximately 6200 $g*cm^2$ to 7600 $g*cm^2$.

Club head parameters or characteristics may be measured physically, or in a computer-aided-design (CAD) environment. Generally, if a 3-dimensional (3D) model of club head 102 is not readily available, one may be created by performing a 3D scan of the club head 102 and creating a model file from the scan data and/or physical measurements, such that the model is substantially representative of the physical club head. In the CAD environment, the model of club head 102 may be set in the reference position with the ball striking surface 109 oriented at the manufacturer's loft, lie, and face angles within the CAD environment such that the model is fully constrained.

Additionally, the golf club 100 may be physically oriented in the reference position using a fixture and method known and used in the art. As was described above, the shaft axis may be aligned at a lie angle according to the golf club manufacturer's specification, or at an appropriate lie angle as determined means described above. The golf club head 102 may rest with its sole 114 contacting a ground plane 124 with the club face 110 positioned at the manufacturer's face angle and/or loft angle using conventional loft and face angle measurement gauges known to one of skill in the art.

As shown in FIG. 3, the ball striking surface 109 may be provided with scorelines or grooves 121, or other surface features or textures enhancing the ability of the club head to grip the golf ball during impact. A grip-enhanced area or a ball striking area 109A may be generally defined by a heel-side score line (or other grip-enhancing surface feature) boundary L1 that is perpendicular to the ground plane 124 and a toe-side score line (or other grip-enhancing surface feature) boundary L2 that is perpendicular to the ground plane 124 and by segments of the top surface 112 and sole 114 perimeter edges of the ball striking area 109A extending between by those heel-side and toe-side boundary lines L1, L2.

As shown in FIGS. 3-7, the face 110 and the body 108 comprising the hosel 126, and/or the hosel 126 may be formed of two or more separate pieces that are connected together by an integral joining technique or another joining technique. The body 108 and the hosel 126 may be formed as a single, integral piece, such as by casting, forging, etc. Alternatively, the face 110 may be formed of a single integral piece with the body 108 and the hosel 126.

The ball striking surface 109 is typically an outer surface of the face 110 configured to face a ball (not shown) in use, and is adapted to strike the ball when the device 100 is set in motion, such as by swinging. As shown, the ball striking surface 109 is relatively planar, occupying most of the face 110. The ball striking surface 109 may include grooves 121 (e.g., generally horizontal grooves 121 extending across the face 110 in the illustrated example) for the removal of water and grass from the face 110 during a ball strike. Of course, any number of grooves, desired groove patterns, and/or groove constructions may be provided (or even no groove pattern, if desired), including conventional groove patterns and/or constructions, without departing from this disclosure.

For reference purposes, the portion of the face 110 nearest the top face edge and the heel 116 of the club head 102 is referred to as the "high-heel area"; the portion of the face 110 nearest the top face edge and toe side 117 of the club head 102 is referred to as the "high-toe area"; the portion of the face 110 nearest the bottom face edge and heel side 116 of the club head 102 is referred to as the "low-heel area"; and the portion of the face 110 nearest the bottom face edge and toe side 117 of the club head 102 is referred to as the "low-toe area". Conceptually, these areas may be recognized and referred to as quadrants of substantially equal size (and/or quadrants extending from a geometric center of the face 110), though not necessarily with symmetrical dimensions.

Additionally, the face 110 may have a plurality of regions having different thicknesses as will be discussed later or alternatively, the face 110 may have a substantially constant face thickness.

The body 108 of the golf club head 102 may be constructed from a wide variety of different materials, including materials conventionally known and used in the art, such as carbon or stainless steel alloys, titanium or titanium alloys, aluminum or aluminum alloys, tungsten, graphite, carbon fiber reinforced polymers, or composites, or combinations thereof. Also, if desired, the club head 102 may be made from any number of pieces (e.g., having a separate face plate, etc.) and/or by any construction technique, including, for example, casting, forging, welding, and/or other methods known and used in the art.

In one embodiment, shown in FIGS. 2-22, the face 110 connects to the body 108 of the club head 102 to form a hollow interior 115. This hollow construction may help to improve the mass properties of the club head 102 as well as provide improved structural support for the face 110. The body 108 may be formed of a single integrally formed piece or may be formed of multiple components, such that the multiple components may be made of different materials. As an example, one component of the body 108 may be made of a stainless steel alloy and another component of the body 108 may be made of a polymer or non-metallic material.

Figure 10:
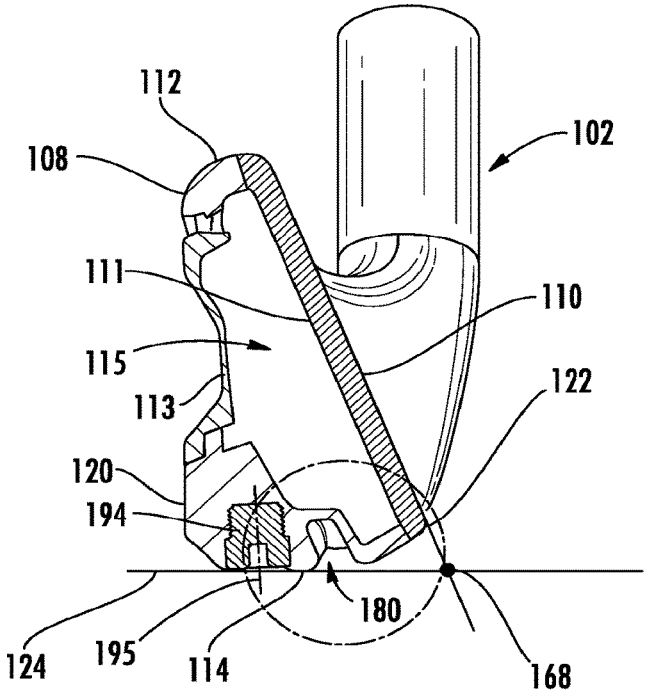
FIG. 10 is a cross-section view of the club head of FIG. 2, taken along line 10-10 of FIG. 3.

As shown in FIG. 10, the club head 102 may be made of multiple components comprising the face 110, the body 108, and a rear body member 113 connected together to form a hollow interior 115. The rear body member 113 may comprise a portion of the rear surface of the club head 102. The rear body member 113 may connect to the body 108 by a bonded joint where the rear body member 113 may be connected to a shelf on the body 108 using an adhesive. The rear body member 113 may be made of a non-metallic material such as an unfilled polymer, carbon fiber composite, a carbon fiber reinforced polymer, or a glass fiber reinforced polymer.

Figure 15:
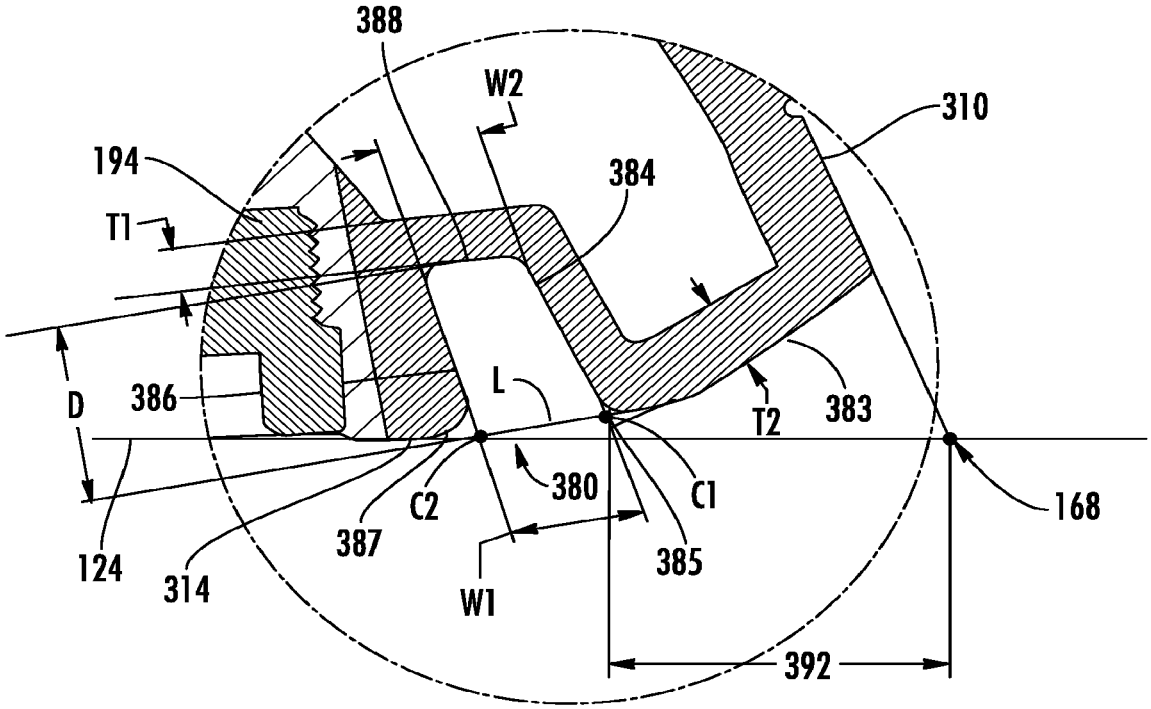
FIG. 15 is a magnified view of FIG. 14.
Figure 16:
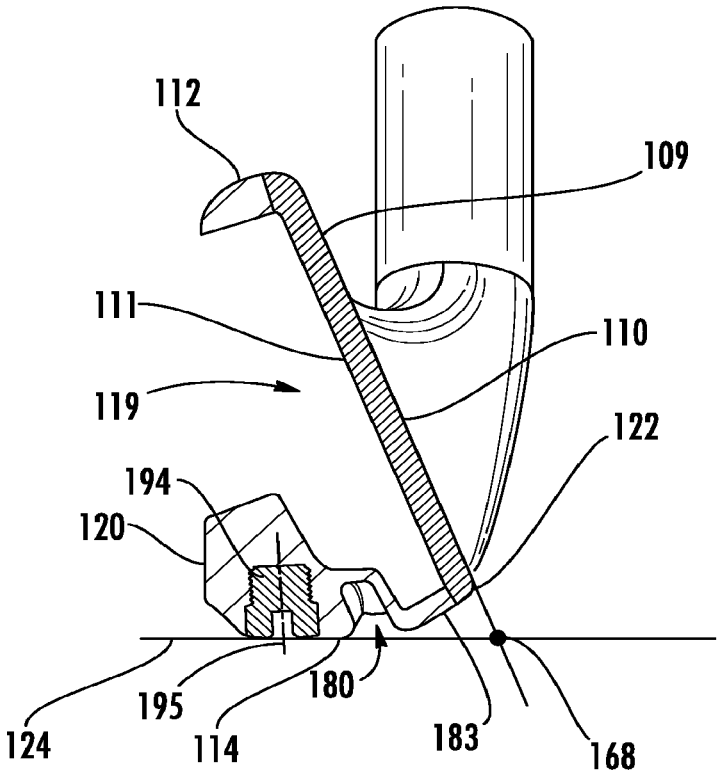
FIG. 16 is a cross-section of an alternate embodiment of the club head of FIG. 2, taken along line 10-10 of FIG. 3.
Figure 17:
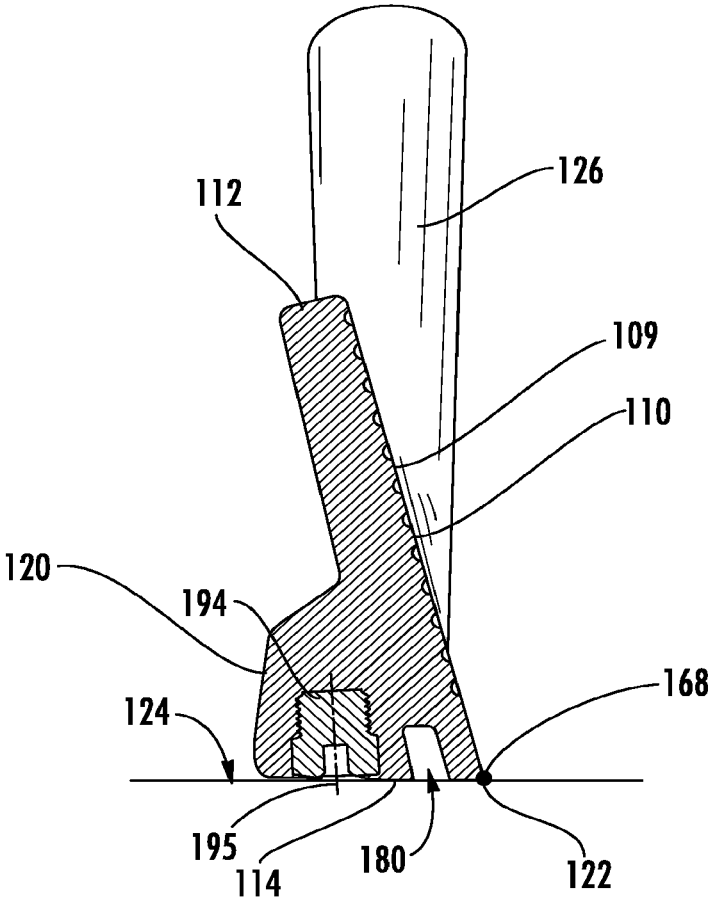
FIG. 17 is a cross-section of an alternate embodiment of the club head of FIG. 2, taken along line 10-10 of FIG. 3.
Figure 18:
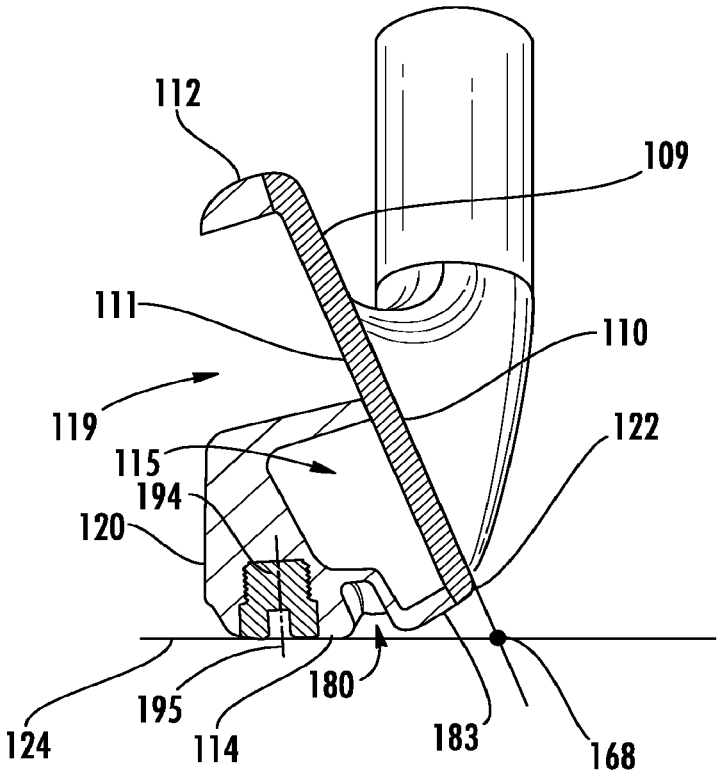
FIG. 18 is a cross-section of an alternate embodiment of the club head of FIG. 2, taken along line 10-10 of FIG. 3.

While the embodiments of club head 102 shown in FIGS. 2-22 show embodiments of the club head 102 having a hollow interior 115, the club head 102 may also be a "cavity back" iron-type club head 102, where the club head 102 has a rear cavity 119 defined by at least the rear surface 111 and the surfaces opposite the top surface 112, toe surface 118, and the sole surface 114 as shown in the cross-section shown in FIG. 16. Additionally, the club head 102 may be a blade-type iron head without a rear cavity or hollow interior, as shown in FIG. 17. Lastly, the club head 102 may have both a hollow interior portion 115 and a rear cavity 119 as shown in FIG. 18.

In general, the club heads 102 according to the present disclosure contain features on the body 108 that influence the impact of a ball on the face 110. Such features may include one or more elongated channels 180 positioned on the body 108 of the club head 102 that allow at least a portion of the body 108 to flex, produce a reactive force, and/or change the behavior or motion of the face 110, during impact of a ball on the face 110. In one embodiment, at least a portion of the elongated channel(s) 180 may extend parallel or generally parallel to one of the adjacent edges of the face 110. In the golf club 100 shown in FIGS. 1-11, the club head 102 includes a single elongated channel 180 located along the sole 114 and extending along at least a portion of the toe surface 118 of the club head 102. As described below, this elongated channel 180 permits compression and flexing of the body 108 and the face 110 during impact on the face 110, and can also produce a reactive force that can be transferred to the ball. Additionally, the design of the channel may help to have better distribute the stresses on the club head 102 during impact with a golf ball. This illustrative embodiment 100 is described in greater detail below.

The golf club 100 shown in FIGS. 1-11 includes an elongated channel 180 positioned on the sole 114 of the club head 102. However, in other embodiments, the club head 102 may have an elongated channel 180 positioned differently on the head 102, such as on the top 112, the heel side 116, and/or the toe surface 118. It is also understood that the head 102 may have more than one elongated channel 180, or may have an annular channel extending around the entire club head 102. Alternatively, the elongated channel 180 may be a plurality of elongated channels positioned in different areas of the club head 102. For example, an elongated channel may be positioned on sole primarily on the heel side 116 and an elongated channel positioned on the sole on the toe side 117 with an area separating the elongated channels.

Figure 9:
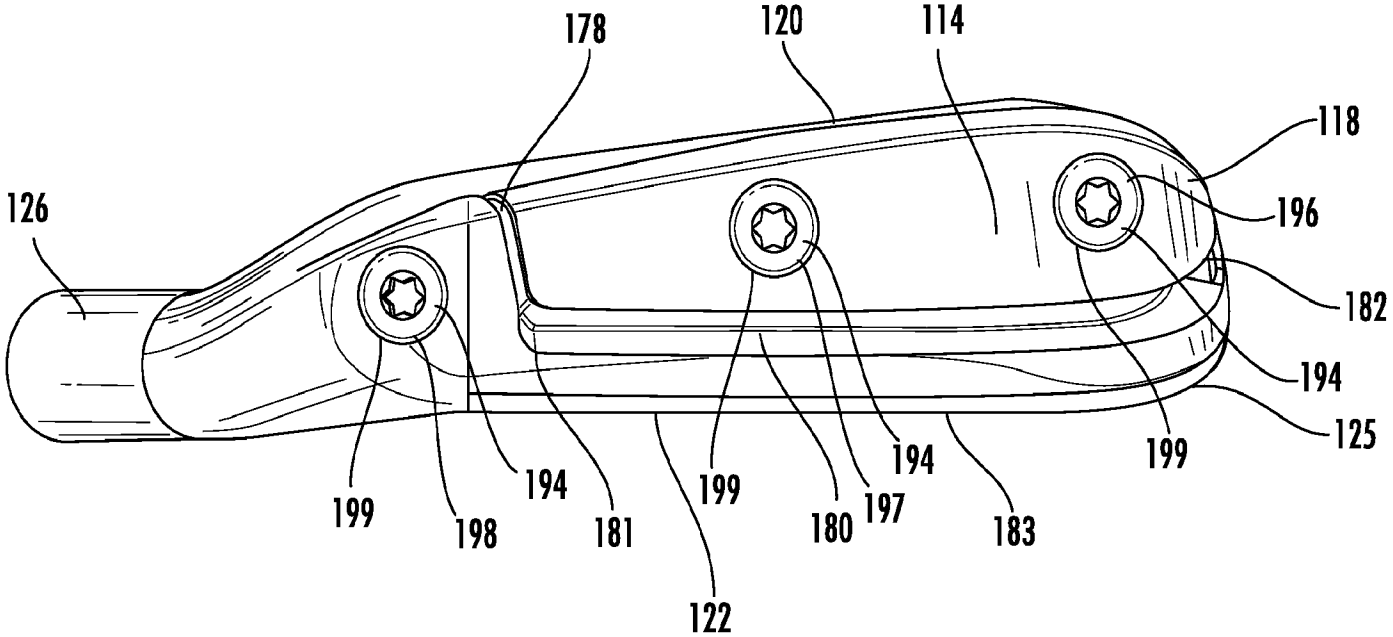
FIG. 9 is a bottom view of the club head of FIG. 2.

As illustrated in FIG. 9, the elongated channel 180 may extend between a first end 181 located proximate the heel side 116 of the club head 102 and a second end 182 located on the toe surface 118 of the club head 102. The elongated channel 180 has a boundary that is defined by a forward wall 184 or forward edge 185 and a rear wall 186 or rear edge 187 that extends between the ends 181, 182. In this embodiment, the elongated channel 180 extends adjacent to and parallel or generally parallel to the leading edge 122 of the club head 102, and the first end 181 is located on the sole 114 and the second end 182 is located on the toe surface 118. It is understood that if the leading edge 122 of the club head 102 has a greater degree of curvature when viewed from the bottom, the elongated channel 180 may have a greater degree of curvature in order to remain generally parallel to the leading edge 122.

The position of the first end 181 of the elongated channel 180 may be defined relative to the end of the scorelines 121 on the heel side 116 of the golf club 102. For example, the first end 181 of the elongated channel 180 may be located approximately even with the end of the scorelines 121 on the heel side 116 of the golf club 102, or within 2 mm towards both the heel side 116 and the toe side 117 of the end of the scorelines 121 on the heel side 116, or within 4 mm towards both the heel side 116 and the toe side 117 of the end of the scorelines 121 on the heel side 116.

The position of the second end 182 of the elongated channel 180 may be defined by an elongated channel toe height 146 defined by the distance from the ground plane 124 to the furthest extent of the elongated channel 180. The elongated channel toe height 146 may be approximately 29 mm, or within a range of 25 mm to 33 mm, or within a range of 21 mm to 37 mm. Alternatively, the position of the second end 182 may be defined as a percentage of the maximum club head height 148. For example, the position of the second end 182 may be approximately 55 percent of a maximum club head height 148 of the golf club, or within a range of 50 percent to 60 percent of a maximum club head height 148, or within a range of 40 percent to 70 percent of the maximum club head height 148 of the golf club, or at least 40 percent of a maximum club head height 148 of the golf club.

Additionally, the position of the second end 182 as a percentage of the maximum club head height 148 may change through a set of golf clubs. For example, the position of the second end 182 as a percentage of the maximum club head height 148 may be lower for a golf club head with a lower loft angle 150 than another golf club head 102 within the set of golf clubs with a higher loft angle 150. For instance, the position of the second end 182 may be within a range of 40 percent to 50 of the maximum club head height 148 for a 4 iron having a loft angle 150 of 21 degrees, and the position of the second end 182 may be within a range of 60 percent to 70 percent of the maximum club head height 148 for a Pitching Wedge having a loft angle 150 of 44 degrees.

In another embodiment, one or both of the ends 181, 182 of the elongated channel 180 may be located on the heel side 116 and/or the toe surface 118 of the club head 102, extending parallel or generally parallel to the heel and toe edges of the face 110. As seen in FIG. 9, at the first end 181, the elongated channel 180 may transition into a groove 178 extending away from the ball striking surface 109 where the groove may connect along the rear surface 120 of the club head to a groove extending away from the ball striking surface 109 at the second end 182 on the toe surface 118 of the club head 102. In other embodiments, the elongated channel 180 may be oriented and/or positioned differently. For example, the elongated channel 180 may not be parallel to any of the edges of the face 110 and may be oriented in a linear direction. Additionally, in this embodiment, the elongated channel 180 is straight or substantially straight along the direction of elongation, but when viewed from the bottom of the club head 102 may have some curvature due to the curvature of the sole surface 114 of the club head 102. The elongated channel 180 may be filled with a compliant or flexible material (not shown) such as a polymer or elastomeric material.

The elongated channel 180 is recessed inwardly with respect to the immediately adjacent surfaces of the club head 102 that are in contact with the forward wall 184 and the rear wall 186 of the elongated channel 180, as shown in FIGS. 2-11. The elongated channel 180 in this embodiment has a polygonal or trapezoidal shape with three walls, the forward wall 184, the rear wall 186, and the upper wall 188 connecting the forward wall 184 and the rear wall 186 as shown in cross-section in FIGS. 10-11. The forward wall 184 may be oriented such that it forms an acute angle with the ball striking surface 109 that can be measured in a cross-section taken. For example, the forward wall 184 and the ball striking surface 109 may be approximately parallel or the forward wall 184 and the ball striking surface 109 may form an angle within a range of −5 degrees and 5 degrees, or within a range of −10 degrees and 10 degrees. Additionally, the rear wall 186 may be oriented parallel to the forward wall 184 or alternatively, the rear wall 186 and the forward wall 184 may form an acute angle. For example, the angle formed between the forward wall 184 and the rear wall 186 may be approximately 5 degrees or may be within a range of 0 degrees and 10 degrees, or within a range of 0 and 20 degrees. Alternatively, the rear wall 186 may be oriented parallel to the forward wall 184. The upper wall 188 may be oriented perpendicular to the ball striking face 109. In addition, the upper wall 188 may have a linear shape or alternatively, have a curved shape. It is understood that the elongated channel 180 may have a different cross-sectional shape as discussed in more detail below, such as a generally rounded or smooth cross-sectional shape, or a polygonal shape having two walls, four walls, five walls, or any number of walls.

The thickness, T1, of both the forward wall 184 and the upper wall 188 of the elongated channel 180 may directly affect the deformation and energy transmitted through the elongated channel 180 during impact. The thickness, T1, may have a variable thickness or may have a constant thickness. The thickness, T1, may be approximately 1.3 mm, or within a range of 1.1 mm to 1.5 mm, or within a range of 0.9 mm to 1.7 mm.

Similarly, the thickness, T2, of the transition surface 183 may directly affect the deformation and energy transferred into the channel during impact. The thickness, T2, may have a variable thickness or may have a constant thickness. The thickness, T2, may be approximately 2.1 mm, or within a range of 1.9 mm to 2.3 mm, or within a range of 1.7 mm to 2.5 mm.

Figure 11:
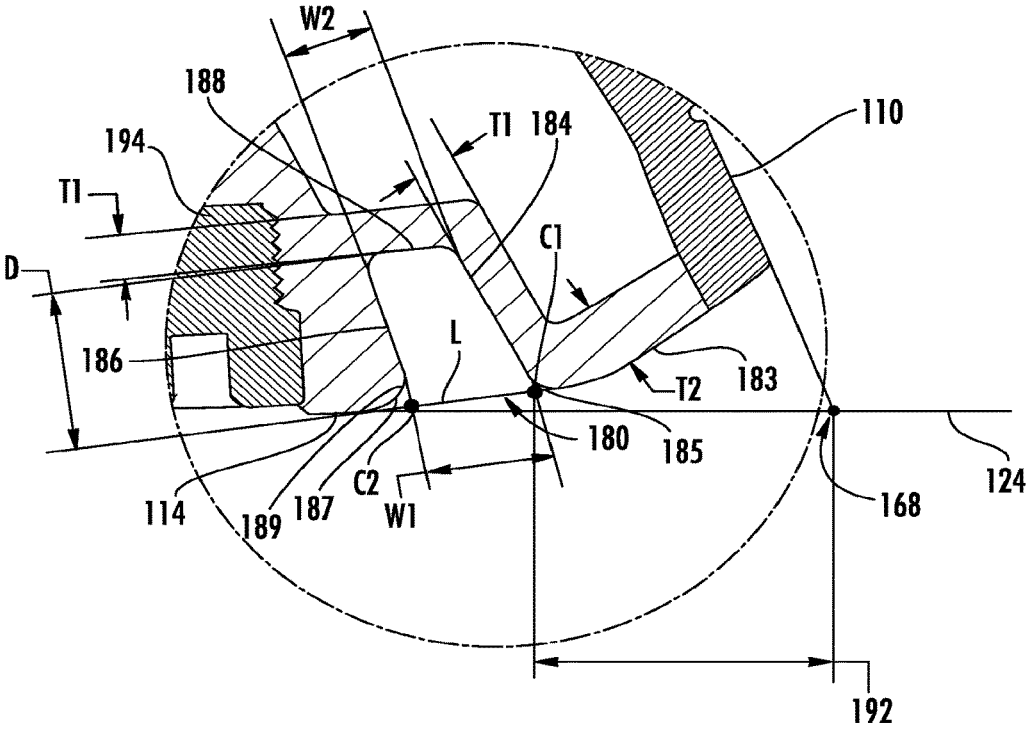
FIG. 11 is a magnified view of FIG. 10.

As shown in FIG. 11, the elongated channel 180 may have a width, W1, defined as the distance from the forward edge 185 to the rear edge 187 along a linear projection, L, from the theoretical end points C1 and C2 when viewed in a cross-section taken along a plane perpendicular to the ground plane 124 and the X-Axis 135. C1 may be defined as the intersection of the forward wall 184 and the transition surface 183 of the sole surface 114. C2 may be defined as the intersection of the rear wall 186 regardless of the size of the rear transition zone 189 and the sole surface 114 rearward of the elongated channel 180. The width, W1, may be substantially constant over the length of the elongated channel 180. For example, the width, W1, may be approximately 3.5 mm, or within a range of 3.0 mm to 4.0 mm, or within a range of 2.0 to 5.0 mm. Additionally, the width, W1, may be larger at the surface of the sole 114 than near the upper wall 188. For example, the width, W1, may be expressed as a ratio compared to a width, W2, near the upper wall 188 such that the ratio of W1 to W2 may be approximately 1.3:1, or within a range of 1.2:1 and 1.4:1. Alternatively, the width, W1, may vary as the elongated channel 180 extends from the first end 181 to the second end 182. For example, the width, W1, may be larger nearer the first end 181 and the second end 182 than in a center portion of the elongated channel 180. Alternatively, the center portion of the elongated channel 180 may have a larger width, W1, than nearer the first end 181 and the second end 182. As another example, the width, W1, may be larger nearer the first end 181 and near a toe side 117 on the sole than on a center portion on the sole 114 and a portion on the toe surface 118.

As shown in FIG. 11, the elongated channel 180 may have a depth, D, defined as the distance perpendicular from the linear projection, L, to the furthest interior point of the elongated channel 180. The depth, D, may be substantially constant over the length of the elongated channel 180. For example, the depth, D, may be approximately 5.0 mm, or within a range of 4.0 mm to 6.0 mm, or within a range of 3.0 mm to 8.0 mm. Alternatively, the depth, D, may vary as the elongated channel 180 extends from the first end 181 to the second end 182. For example, the depth, D, may be tapered where the depth, D, may be larger nearer a center portion than near the first end 181 and the second end 182. Alternatively, the center portion of the elongated channel 180 may have a smaller depth, D, than nearer the first end 181 and the second end 182. As another example, the depth, D, may be larger nearer the first end 181 and near a toe side 117 on the sole than on a center portion on the sole 114 and a portion on the toe surface 118. Additionally, the depth, D, of the elongated channel 180 may decrease smoothly from a center portion of the elongated channel 180 toward the ends 181, 182 of the elongated channel 180.

In the embodiment shown in FIGS. 2-22, the elongated channel 180 may be spaced from the leading edge 122 and the toe edge 125 of the face 110 with the transition surface 183 defined between the elongated channel 180 and the leading edge 122 of the club head 102 and a toe edge 125 of the face 110. The transition surface 183 is located immediately adjacent the elongated channel 180 from the forward wall 184 of the elongated channel 180 to the leading edge 122 and the toe edge 125 as shown in FIGS. 9-11. For example, the transition surface 183 may be oriented at an acute (i.e. <90°) angle to the ball striking surface 109, or it may be oriented substantially perpendicular to the ball striking surface 109. Force from an impact with a golf ball on the face 110 can be transferred to the elongated channel 180 through the transition surface 183. In other embodiments, the transition surface 183 may be oriented at a right angle or an obtuse angle to the ball striking surface 109, or the transition surface 183 may be smaller than shown in FIGS. 9-11 or absent entirely. For example, in one embodiment, the elongated channel 180, or a portion thereof, may be positioned immediately adjacent the leading edge 122 and the toe edge 125 of the face 110, and in another embodiment, the elongated channel 180, or a portion thereof, may be spaced much farther from the leading edge 122 of the club head 102.

To locate the forward edge 185 of the elongated channel 180, an intermediary point needs to be defined. A leading edge intersection point 168 may be defined at an intersection of the center plane 144, the ground plane 124, and the plane 152 defined by the ball striking surface 109. The forward edge 185 of the forward wall 184 may be defined as a dimension 192 from the leading edge intersection point 168 in the Y-Axis 137 direction. The dimension 192 may be approximately 9 mm, or may be within a range of 8 mm and 10 mm, or within a range of 6 mm and 12 mm.

The parameters of the elongated channel 180 may be best expressed as ratios as shown in Table 2. For example, the ratio of the width, W1, of the elongated channel 180 to the depth, D may be approximately 0.70:1, or within a range of 0.57:1 to 0.90:1, or within a range of 0.50:1 to 1.20:1. Additionally, the ratio of the width, W1, of the elongated channel 180 to the channel thickness, T1, may be approximately 2.70:1, or within a range of 2.43:1 to 3.00:1. Lastly, the ratio of the depth, D, of the elongated channel 180 to the channel thickness, T1, may be approximately 3.85:1, or within a range of 2.86:1 to 5.00:1, or within a range of 2.14:1 to 5.83:1.

TABLE 2

Elongated Channel Parameter Ratios

| Description | Approx. Ratio | Ratio Range |
|---|---|---|
| Elongated Channel Width/Elongated Channel Depth | 0.70:1 | 0.57:1 to 0.90:1 or 0.50:1 to 1.20:1 |
| Elongated Channel Width/Elongated Channel Thickness | 2.70:1 | 2.43:1 to 3.00:1 |
| Elongated Channel Depth/Elongated Channel Thickness | 3.85:1 | 2.86:1 to 5.00:1 or 2.14:1 to 5.83:1 |

Weighting Elements

As shown in FIG. 9, the club head 102 may have a plurality of weighting elements 194 positioned on the club head 102 to adjust the center of gravity and moment of inertia of the golf club head 102. The weighting elements 194 may help to adjust the center of gravity of the club head 102 by positioning a heavier weight near the heel side 116 the center of gravity may move towards the heel side 116 or similarly if a heavier weight is positioned near the toe side 117 the center of gravity may move towards the toe side 117. The plurality of weighting elements 194 may be positioned on the sole surface 114 or positioned on a combination of both the sole surface 114 and the toe surface 118. Also, each weighting element 194 may have a longitudinal axis 195 (as shown in FIG. 10) such that the weighting element is oriented along an axis 195 that is substantially perpendicular to the surface having the weighting element 194. For example, at least one weighting element 194 may be oriented along an axis 195 that is substantially perpendicular to the sole surface 114 or alternatively, at least one weighting element 194 may be oriented along an axis 195 that is substantially perpendicular to the toe surface 118. The plurality of weighting elements 194 may comprise any number of weighting elements 194 such as 2 weighting elements 194, 3 weighting elements 194, 4 weighting elements 194, or even 5 or more weighting elements 194, including for example, 10 weighting elements 194. Alternatively, the plurality of weighting elements 194 may be a single weighting element 194, where the single weighting element 194 may be positioned on the sole surface 114 or the toe surface 118. The single weighting element 194 may be positioned near the center of the club head 102, near the heel side 116, or near the toe side 117.

The plurality of weighting elements 194 may be spaced apart from one another. For example, as shown in FIG. 9, the plurality of weighting elements 194 comprises three (3) weighting elements 196, 197, 198 where a first weighting element 196 is positioned near the toe side 117 on the toe surface 118, a second weighting element 197 is positioned near a center of the sole surface 114, and a third weighting element 198 is positioned near the heel side 116 of the sole surface 114. In addition, the position of first weighting element 196 may be located approximately 35.5 mm from the face center 140 toward the toe side 117 of the club head 102, or within a range of 25 mm to 40 mm from the face center 140 toward the toe side 117 of the club head 102, the second weighting element 197 may be approximately at the face center 140, or within a range of 10 mm towards the heel side 116 of the face center 140 to 10 mm towards the toe side 117 of the face center 140, and the third weighting element 198 may be located approximately 35.5 mm from the face center 140 toward the heel side 116 of the club head 102, or within a range of 25 mm to 40 mm from the face center 140 toward the heel side 116 of the club head 102. Another way to define the location of the weighting elements 194 may be to define their locations relative to the end of the scorelines 121. For example, the position of first weighting element 196 may be located 10 mm towards the toe side 117 from the end of the scorelines on the toe side 117 to 2 mm towards the heel side 116 from the end of the scorelines on the toe side 117. The second weighting element 197 may be located within a range of 10 mm towards the heel side 116 of the face center 140 to 10 mm towards the toe side 117 of the center of the scorelines 121. The third weighting element 198 may be located 10 mm towards the toe side 117 from the end of the scorelines on the toe side 117 to 2 mm towards the heel side 116 from the end of the scorelines on the toe side 117.

As an alternate embodiment, the plurality of weighting elements 194 may comprise two weighting elements 196 and 198 with the locations of the weighting elements 196 and 198 defined as described above.

Additionally, at least one of the plurality of weighting elements 194 may be positioned rearward of the elongated channel 180. For example, in FIG. 9, the first weighting element 196 and the second weighting element 197 may be positioned rearward of the elongated channel 180.

The club head body 108 may have a plurality of cavities 199 that are able to receive the plurality of weighting elements 194. The cavities 199 may have a shape that corresponds to the shape of the weighting elements 194 such that the weighting elements 194 may be contained within the cavities 199. The weighting elements 194 may be substantially flush with the adjacent surface or positioned just below, within 2 mm, the adjacent surface to the weighting element 194.

The plurality of weighting elements 194 may be removable and interchangeable by the user. For example, the plurality of weighting elements 194 may all be the same size and volume, such that a weighting element 194 may be installed into any of the cavities 199 on the club head body 108. The weighting elements 194 may be secured into the bodies by a releasable means such as corresponding threaded features on both the weighting element 194 and cavity 199. The weighting elements 194 may be a unitary construction or constructed of multiple components where a securing element is a separate portion of the weighting element 194.

The weighting elements 194 may be formed of metallic materials of various densities, such as aluminum, steel, tungsten, or other alloys. Alternatively, the weighting elements may be formed of a nonmetallic material such as a polymer with tungsten loaded particles, or a composite of a polymer material molded around a heavier metallic material. The different materials may enable the weighting elements 194 to have different weights. For example, each weighting element 194 may have a weight ranging between 0.5 grams to 7.0 grams. The weighting elements 194 may be arranged such that each weighting element 194 may be made of the same material, or may be arranged such that each weighting element 194 may be made of a different material, or in an embodiment having three weighting elements 194 may be arranged such that two of the weighting elements are made of the same material and a third weighting element is made of a different material. Each weighting element 194 may have any shape such as a cylindrical shape having a round, a parallelepiped shape having a rectangular or square top surface. Additionally, each weighting element 194 may have side walls that may be slightly tapered. For example, the weighting elements 194, shown in the embodiment of FIG. 9, may have a cylindrical shape. The cylindrical weighting elements 194 may have diameter of approximately 7.5 mm or within a range of 6.0 mm to 9.0 mm and a height of approximately 8.5 mm or within a range of 6.5 mm to 10.5 mm.

Construction

Another aspect of the present disclosure relates to the overall construction of the club head 102, specifically with how the face plate 110 may be connected to the body 108. In the embodiment shown in FIGS. 2-11, the face plate 110 extends from the top surface 112 to the sole surface 114 and from the toe surface 118 to a heel side 116 near where the hosel 126 transitions into the face plate 110. The face plate 110 may be connected to the body 108 by an integral joining technique. For example, the face plate 110 may be welded around the top surface 112, toe surface 118, and sole surface 114. Extending the face plate to the edges of the club head body 102 and having the connection location moved to the edges may help to improve the responsiveness of the face plate 110, which may help to improve the COR and overall ball speed seen after the impact with a golf ball.

The integral joining technique used to join the face plate 110 and the body 108 may be welded together. The type of welding process used may affect the strength of the materials locally because of the heat affected zone. For example, a TIG welding process may produce the largest heat affected zone, a plasma welding process may produce a smaller heat affected zone than the TIG process, and a laser welding process may produce a smaller heat affected zone than both the plasma and the TIG welding process. Additionally, if the welding process is a manual operation dependent upon human welders or an automated robotic process can greatly impact the size of the heat affected zone. By limiting the heat affected zone, the various thickness profiles of the golf club head may be reduced because the integrity and strength of the materials have not been compromised by the welding process.

In the embodiments shown in FIGS. 2-11, an automated robotic welding process may be implemented to weld the face plate 110 to the club head body 108 around the top surface 112, toe surface 118, and sole surface 114. Alternatively, a manual or robotic plasma weld process may be implemented to weld the face plate 110 to the club head body 108 around the top surface 112, toe surface 118, and sole surface 114.

The material for the face plate 110 may be a stainless steel, such as 17-4 PH or a high strength stainless steel and may be formed by forging, stamping, forming, or machining. While the body 108 may be formed via a casting or forging process of a carbon or stainless steel. As previously mentioned, the body 108 may be formed as a single integral piece or formed from multiple components, where the multiple components are formed of different materials. For example, the body 108 may be formed of a first component made of a metallic material, like stainless steel, and a second component made of a non-metallic material, like a carbon fiber reinforced polymer.

Figure 12:
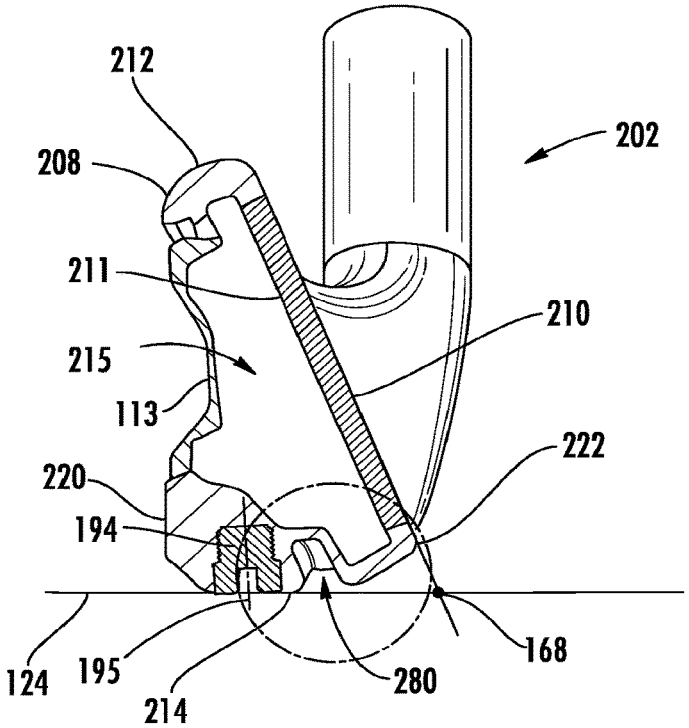
FIG. 12 is a cross-section of an alternate embodiment of the club head of FIG. 2, taken along line 10-10 of FIG. 3.
Figure 13:
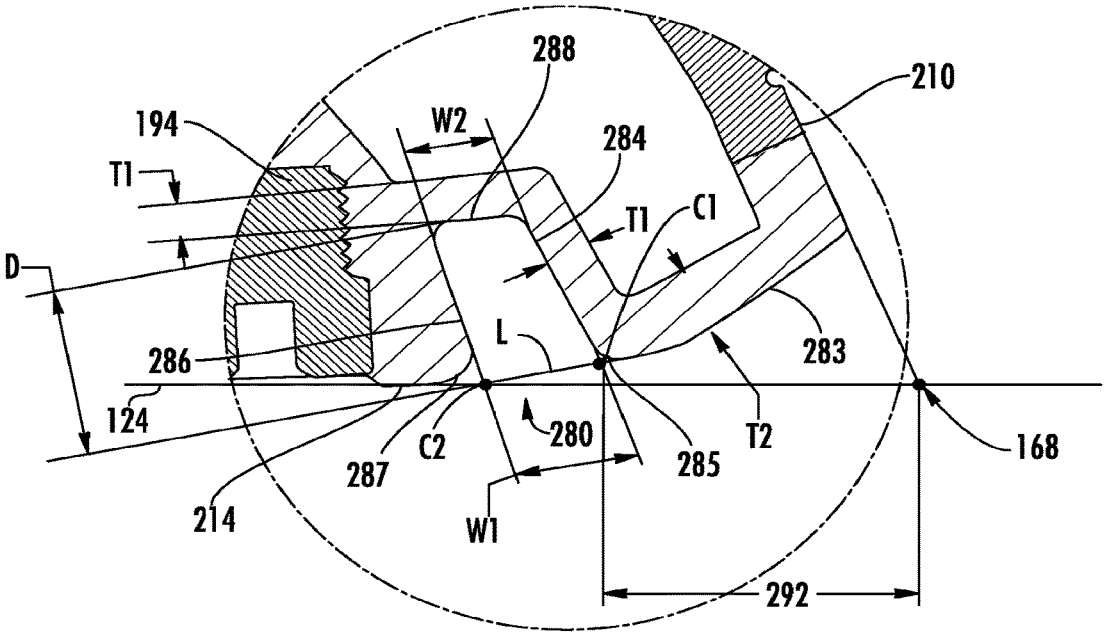
FIG. 13 is a magnified view of FIG. 12.

An alternate embodiment of golf club head 202 showing an alternate construction of golf club 102 is illustrated in FIGS. 12-13 of a face plate 210 connected to the body 208 in a face-pull type construction. Many features of the club 200 and the head 202 shown in FIGS. 12-13 are similar to features described above with respect to the club 100 and the head 102 in FIGS. 1-11. Such similar features are referenced in FIGS. 12-13 with similar reference numerals, using the "2xx" series of reference numerals. Accordingly, some features of the club 200 and the head 202 in FIGS. 12-13 that are similar to the features of the club 100 and head 102 in FIGS. 1-11 may not be re-described or may be described in lesser detail below, and some features of the club 200 and the head 202 may be described only with respect to the differences from the club 100 and the head 102 in FIGS. 1-11. As such, certain drawing figures may be unnecessary and duplicative of other drawing figures herein.

Club head 202 has a face plate 210 connected to the body 208 wherein a portion of the body 208 is coplanar with the ball striking surface 209 of the face plate at a toe side 217, a sole side 214, and a top side 212. The body 208 may have a top surface 212, a sole surface 214, a heel side 216, a toe side 217, a toe surface 218 and a rear surface 220 and a portion of the ball striking surface 209 along the edges around the top surface 212, sole surface 214, and the toe side 217. In general, except for the differences described above, including the face plate 210 and the connection to the club head body 208, the head 202 is otherwise similar to the head 102 in FIGS. 1-11, and contains many similar features.

Figure 14:
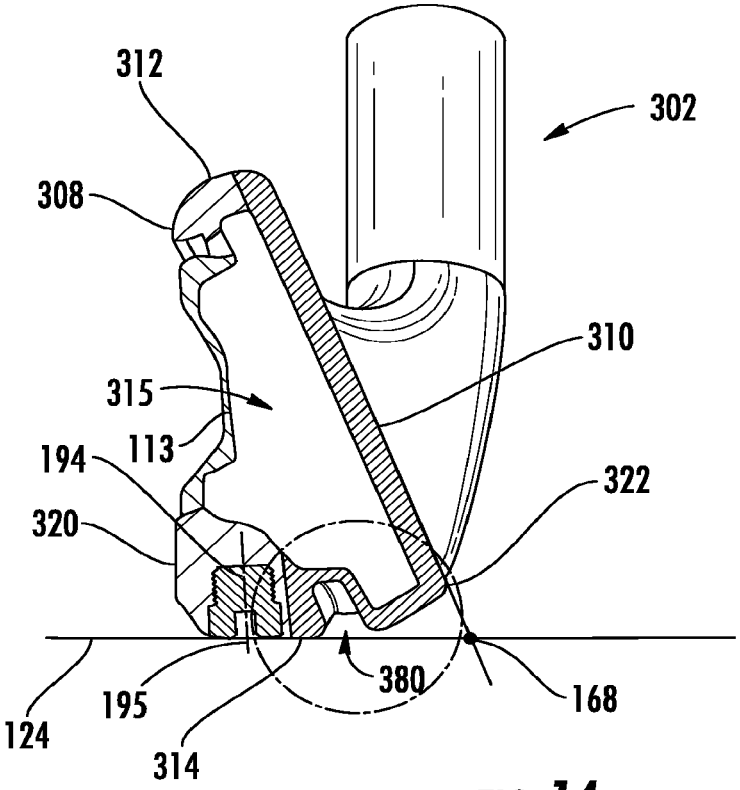
FIG. 14 is a cross-section of an alternate embodiment of the club head of FIG. 2, taken along line 10-10 of FIG. 3.

Another alternate embodiment of golf club head 302 showing an alternate construction of golf club 102 is illustrated in FIGS. 14-15 of a face member 310 connected to the body 308 cup face type construction. Many features of the club 300 and the head 302 shown in FIGS. 14-15 are similar to features described above with respect to the club 100 and the head 102 in FIGS. 1-11. Such similar features are referenced in FIGS. 14-15 with similar reference numerals, using the "3xx" series of reference numerals. Accordingly, some features of the club 300 and the head 302 in FIGS. 14-15 that are similar to the features of the club 100 and head 102 in FIGS. 1-11 may not be re-described or may be described in lesser detail below, and some features of the club 300 and the head 302 may be described only with respect to the differences from the club 100 and the head 102 in FIGS. 1-11. As such, certain drawing figures may be unnecessary and duplicative of other drawing figures herein.

An alternate embodiment of golf club head 302 showing an alternate construction of golf club 102 is illustrated in FIGS. 14-15 of a face member 310 connected to the body 308 where the face member 310. FIGS. 14-15 shows an embodiment where the face member 310 may comprise the ball striking surface 109, a portion of the sole 314, and a portion of the toe surface 318. The face member 310 also comprises the elongated channel 380. The elongated channel 380 may extend from a first end 381 near a heel side 316 of the portion of the sole 314 of the face member 310 to a second end 382 on the portion of the toe surface 318 of the face member 310. The body member 308 comprises a portion of the top surface 312, a portion of the sole surface 314, a portion of the toe surface 318, and a rear surface 310. The face member 310 may be connected to the body 308 rearward of the elongated channel 380, which may allow for additional flexibility and responsiveness because the heat affected zone from the weld line is rearward of the elongated channel 380. In general, except for the differences described above, including the face member 310 and the connection to the club head body 308, the head 302 is otherwise similar to the head 102 in FIGS. 1-11, and contains many similar features.

Alternate Channel Cross-Sections

Figure 19:
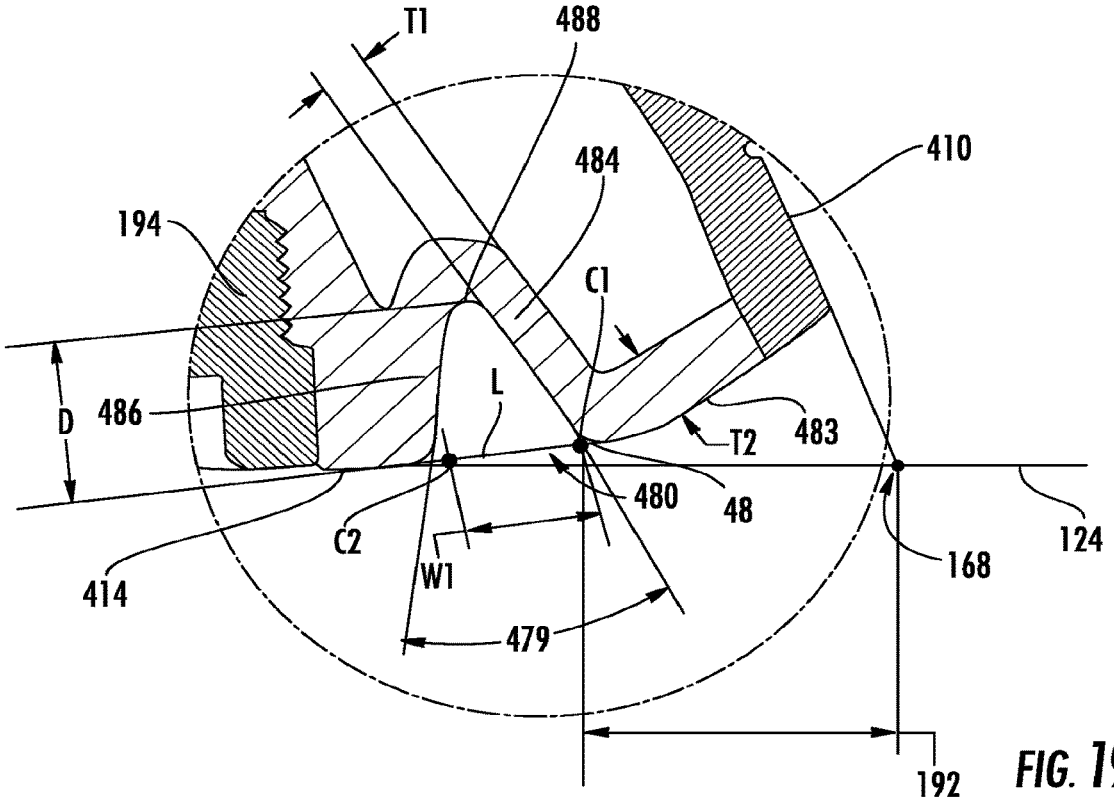
FIG. 19 is view of an alternative embodiment of FIG. 11.

Another aspect of the present disclosure relates to alternate cross-sectional channel 180 shapes. The alternate cross-sectional shapes may provide a different response to the golf club head's impact with a golf ball. An alternate embodiment of the channel cross-section of the channel is shown in golf club head 402 in FIG. 19. Many features of the golf club head 402 shown in FIG. 19 are similar to features described above with respect to the golf club head 102 in FIGS. 1-11. Such similar features are referenced in FIG. 19 with similar reference numerals, using the "4xx" series of reference numerals. Accordingly, some features of the golf club head 402 in FIG. 19 that are similar to the features of the club head 102 in FIGS. 1-11 may not be re-described or may be described in lesser detail below, and some features of the club head 402 may be described only with respect to the differences from the club head 102 in FIGS. 1-11. As such, certain drawing figures may be unnecessary and duplicative of other drawing figures herein.

Club head 402 in FIG. 19 shows the channel 480 with a cross-sectional shape with generally a V-Shape. The elongated channel 480 comprises a forward wall 484 and a rear wall 486 that converge toward one another and form an acute angle 479. Angle 479 may be approximately 20 degrees or within a range of 10 degrees and 40 degrees. The forward wall 484 and rear wall 486 intersect and may have a radius 488 formed between the forward and rear walls 484, 486 to avoid a sharp corner at the intersection and reduce the stresses at the juncture. Radius 488 may be approximately 2 mm or may have a range of 1 mm to 4 mm. Additionally, the width W1, depth D, and thicknesses T1 and T2 will be measured and have similar ranges as described above.

Figure 20:
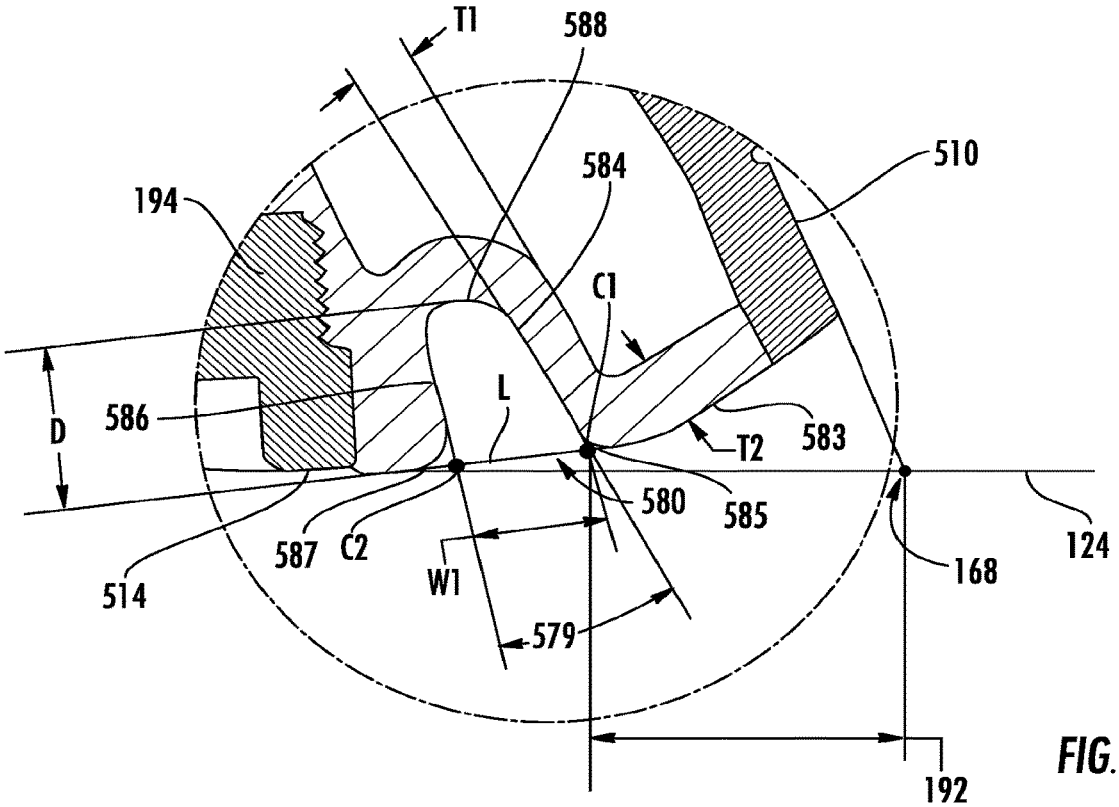
FIG. 20 is view of an alternative embodiment of FIG. 11.

Another alternate embodiment of the channel cross-section of the channel is shown in golf club head 502 in FIG. 20. Many features of the golf club head 502 shown in FIG. 20 are similar to features described above with respect to the golf club head 102 in FIGS. 1-11. Such similar features are referenced in FIG. 20 with similar reference numerals, using the "5xx" series of reference numerals. Accordingly, some features of the golf club head 502 in FIG. 20 that are similar to the features of the club head 102 in FIGS. 1-11 may not be re-described or may be described in lesser detail below, and some features of the club head 502 may be described only with respect to the differences from the club head 102 in FIGS. 1-11. As such, certain drawing figures may be unnecessary and duplicative of other drawing figures herein.

Club head 502 in FIG. 20 shows the channel 580 with a cross-sectional shape with generally a U-Shape. The elongated channel 580 comprises a forward wall 584 and a rear wall 586 that may be connected by a curved wall 588. The forward wall 584 and rear wall 586 may be parallel to each other or may converge toward one another and form an angle 579. Angle 585 may be approximately 5 degrees or within a range of 0 degrees and 20 degrees. The curved wall 488 may have a curvature defined by a radius of approximately 3 mm or may have a range of 2 mm to 5 mm. Additionally, the width W1, depth D, and thicknesses T1 and T2 will be measured and have similar ranges as described above.

Figure 21:
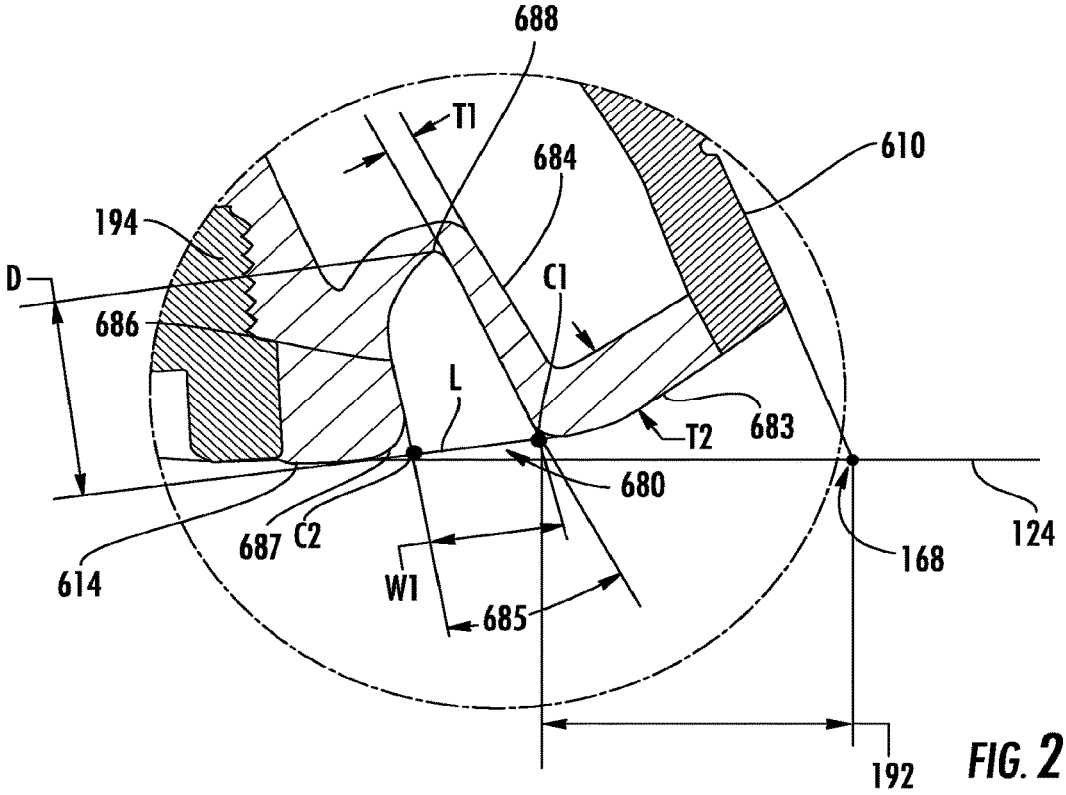
FIG. 21 is a view of an alternative embodiment of FIG. 11.

Another alternate embodiment of the channel cross-section of the channel is shown in golf club head 602 in FIG. 21. Many features of the golf club head 602 shown in FIG. 21 are similar to features described above with respect to the golf club head 102 in FIGS. 1-11. Such similar features are referenced in FIG. 21 with similar reference numerals, using the "6xx" series of reference numerals. Accordingly, some features of the golf club head 602 in FIG. 21 that are similar to the features of the club head 102 in FIGS. 1-11 may not be re-described or may be described in lesser detail below, and some features of the club head 602 may be described only with respect to the differences from the club head 102 in FIGS. 1-11. As such, certain drawing figures may be unnecessary and duplicative of other drawing figures herein.

Club head 602 in FIG. 21 shows the channel 680 with an asymmetrical cross-sectional shape having a forward wall 684 that may be oriented substantially parallel to the rear wall 686. The elongated channel 680 comprises a forward wall 684 and a rear wall 686 that may be connected by a curved wall 688. The curved wall 688 may be asymmetrically shaped such that the radius of curvature of the curved wall 688 may be substantially larger near the rear wall 686 than the forward wall 684. The forward wall 684 and rear wall 686 may be parallel to each other or may converge toward one another and form an acute angle 685. Angle 685 may be approximately 5 degrees or within a range of 0 degrees and 20 degrees. Additionally, the width W1, depth D, and thicknesses T1 and T2 will be measured and have similar ranges as described above.

Alternative Channel Trailing Edge Configurations

Figure 22A:
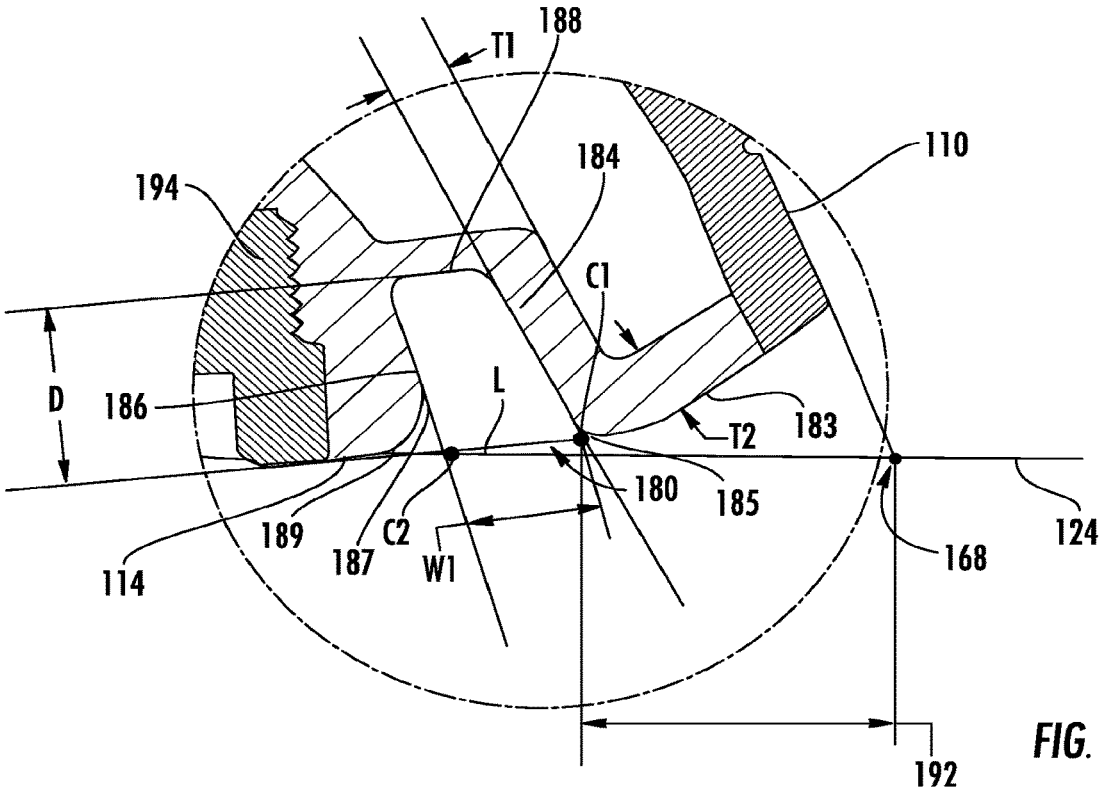
FIG. 22A is a view of an alternative embodiment of FIG. 11.
Figure 22B:
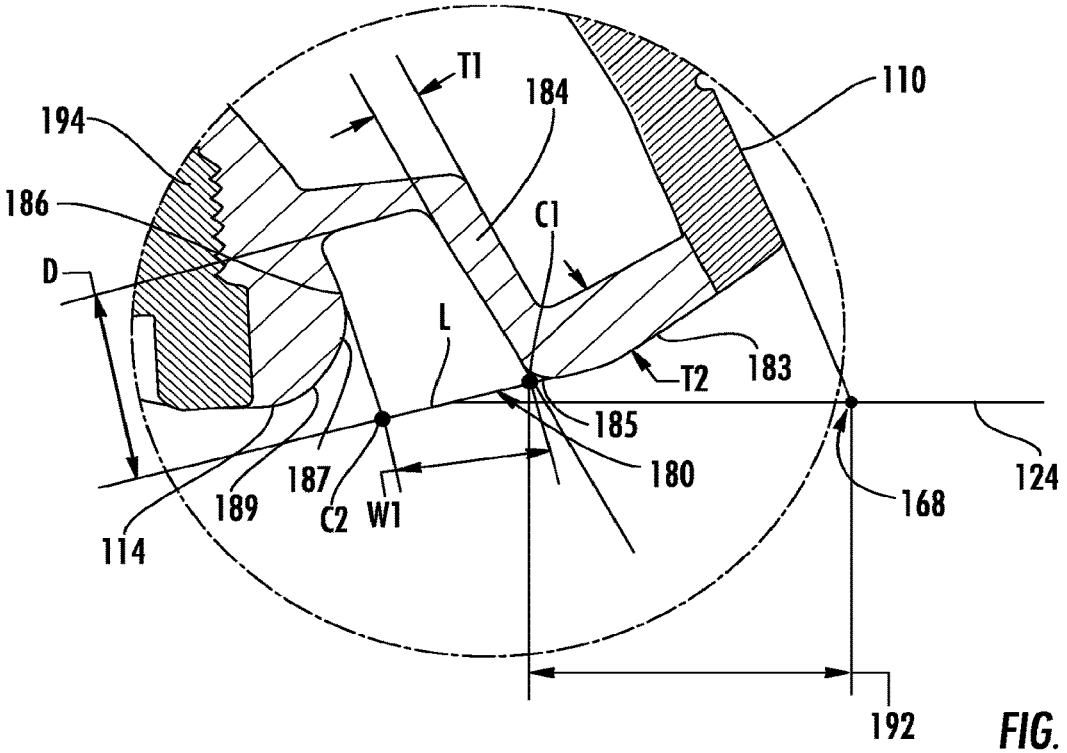
FIG. 22B is a view of an alternative embodiment of FIG. 11.
Figure 22C:
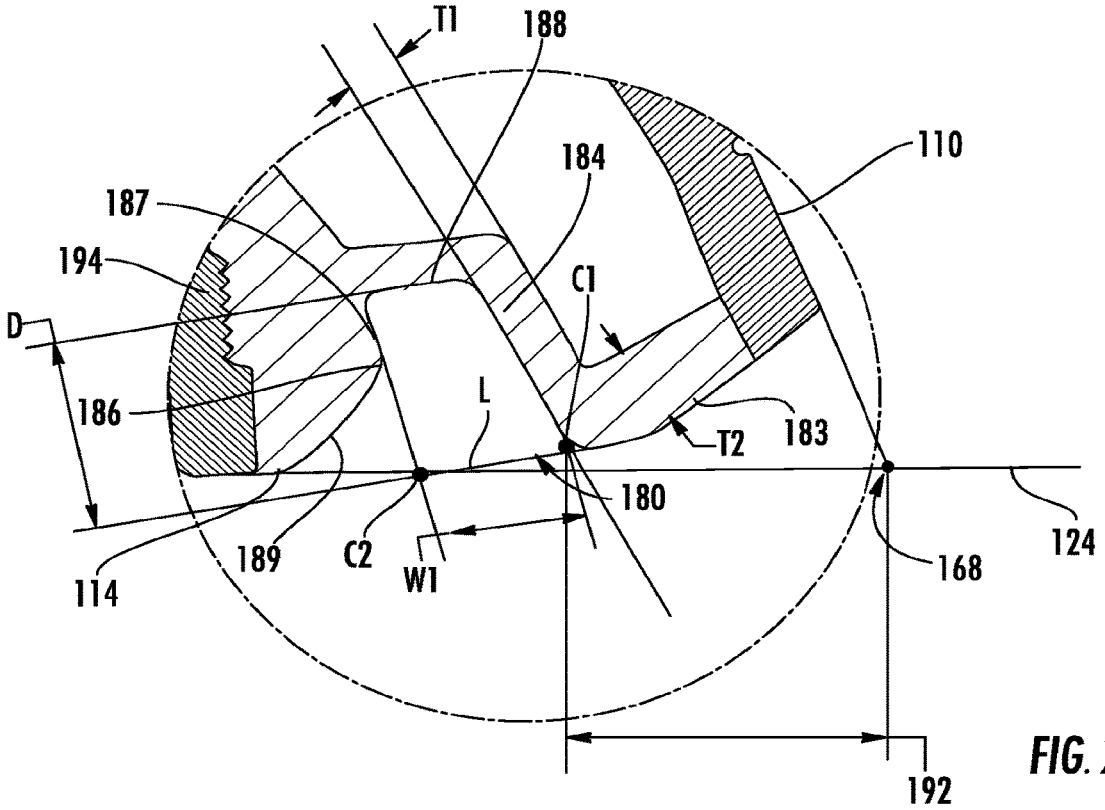
FIG. 22C is a view of an alternative embodiment of FIG. 11.

As another element of the elongated channel 180 cross-sectional profile, a rear transition zone 189 may connect and provide a smooth transition from the rear wall 186 of the elongated channel 180 to the sole 114 behind the elongated channel 180. The rear transition zone 189 may have a variety of shapes, such as a fillet radius or as an angled surface between connecting the rear wall 186 of the elongated channel 180 to the sole 114 behind the elongated channel 180. Additionally, the rear transition zone 189 may have a height that may be defined as a percentage of the depth D of the elongated channel 180, where the height of the rear transition zone 189 may be measured in the same direction and manner as the depth D. For example, the rear transition zone 189 may be a fillet radius that has a height that may be less than 15 percent of the depth D of the elongated channel 180. An alternate embodiment shown in FIG. 22A, the rear transition zone 189 may have a fillet radius that has a height that may be within a range of 15 percent to 25 percent of the depth D of the elongated channel 180, or may be within a range of 15 percent to 50 percent of the depth D of the elongated channel 180. As another alternate embodiment, the rear transition zone 189 may comprise an angled surface forming an angle between 15 degrees and 45 degrees with the rear wall 186 and having a height within a range of 15 percent to 25 percent of the depth D of the elongated channel 180, or may be within a range of 15 percent to 50 percent of the depth D of the elongated channel 180 as shown in FIGS. 22B and 22C.

Face Designs

Yet another aspect of present disclosure relates to a face 110 having a shape that may help to better distribute the stresses from the impact with a ball and may improve the response of the face 110, which may improve the ball speed after impact. The face 110 and the elongated channel 180 may work together to improve the COR for impacts across the face.

Figure 23:
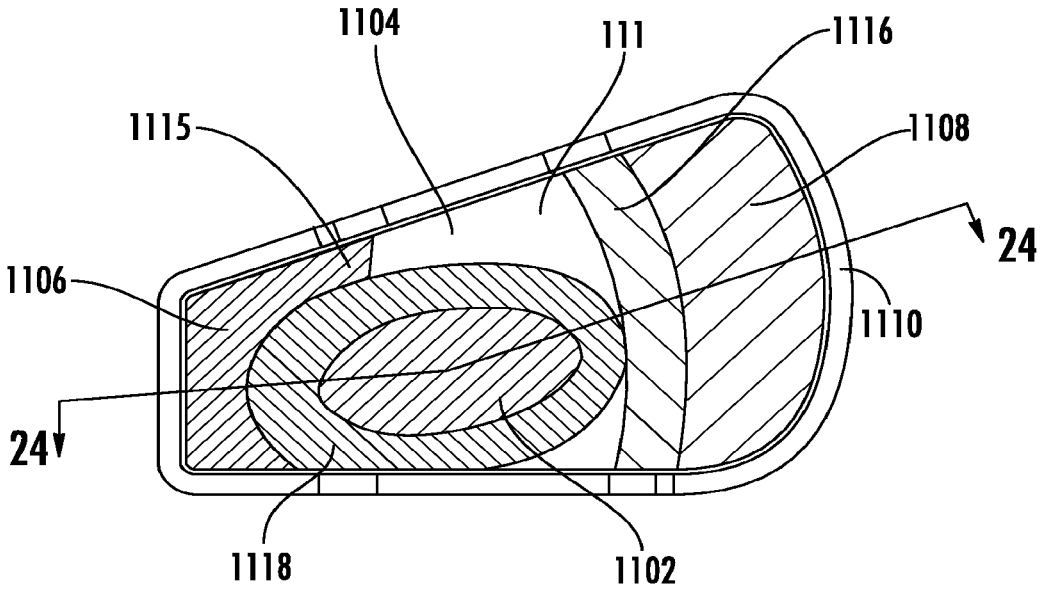
FIG. 23 is a rear view of the face plate of the iron-type club head of FIG. 2, with the club head body removed for clarity.
Figure 24:
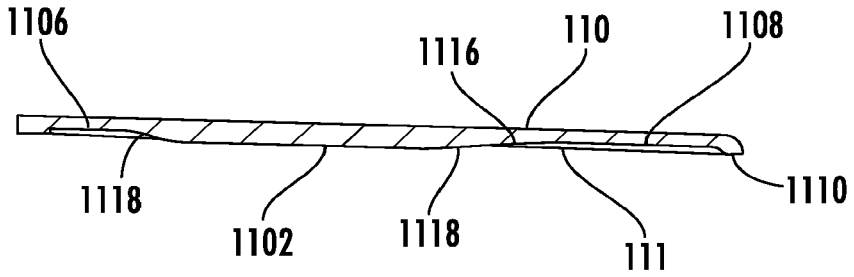
FIG. 24 is a cross-section of the face plate of FIG. 23, taken along line 24-24.

Another aspect of the club head 102 is a face 110 having multiple thickness regions as illustrated in FIGS. 23 and 24. FIG. 23 shows the rear surface 111 of the face 110 opposite the ball striking surface 109. The face 110 may have a plurality of regions having different thicknesses. For example, the plurality of regions may include a central region 1102 having a first thickness, a middle region 1104 having a second thickness, a heel region 1106 having a third thickness, a toe region 1108 having a fourth thickness, and a perimeter region 1110. The central region 1102 may have a thickness that is greater than the thickness of the other regions. The middle region 1104 may have a thickness that is less than the central region 1102, but greater than the thicknesses of the heel region 1106 and the toe region 1108. Additionally, the heel region 1106 and the toe region 1108 may have the same thickness, or alternatively, the heel region 1106 and the toe region 1108 may have different thicknesses.

The central region 1102 may be located near the face center location 140. The central region 1102 may have a generally oval shape with a major axis and a minor axis, wherein the major axis may be oriented in a direction from a low heel side to an upper toe side. The central region 1102 may have a thickness of approximately 2.7 mm, or within a range of 2.6 mm to 2.8 mm, or within a range of 2.5 mm to 2.9 mm. The middle region 1104 may be positioned from a top 1112 edge of the face plate 110 to a bottom edge 1114 of the face plate 110 shaping around at least a portion of central region 1102. The middle region 1104 may have a thickness of approximately 2.2 mm, or within a range of 2.1 mm to 2.3 mm, or within a range of 2.0 mm to 2.4 mm. The toe region 1108 may be proximate the toe side 117 of the face plate 110. The toe region 1108 may have a thickness of approximately 1.6 mm, or within a range of 1.5 mm to 1.7 mm, or within a range of 1.4 mm to 1.8 mm. The heel region 1106 may be proximate the heel side 116 of the face plate 110. The heel region 1106 may have a thickness of approximately 1.6 mm, or within a range of 1.5 mm to 1.7 mm, or within a range of 1.4 mm to 1.8 mm. Optionally, the relative thicknesses of the regions may be expressed as a ratio such that the ratio of the thickness of the central region 1102 compared to either the thickness of either the heel region 1106 or the thickness of the toe region 1108 may be within a range of 1.85:1 and 1.55:1.

Additionally, a plurality transition zones are positioned between the regions where the thickness ramps linearly, or smoothly, from one region to the other. For example, there are end transition zones 1115, 1116 between the middle region 1104 and the heel and toe regions 1106, 1108. A central transition zone 1118 may be positioned between the central region 1102 and the middle region 1104 and the heel region 1106.

Figure 25:
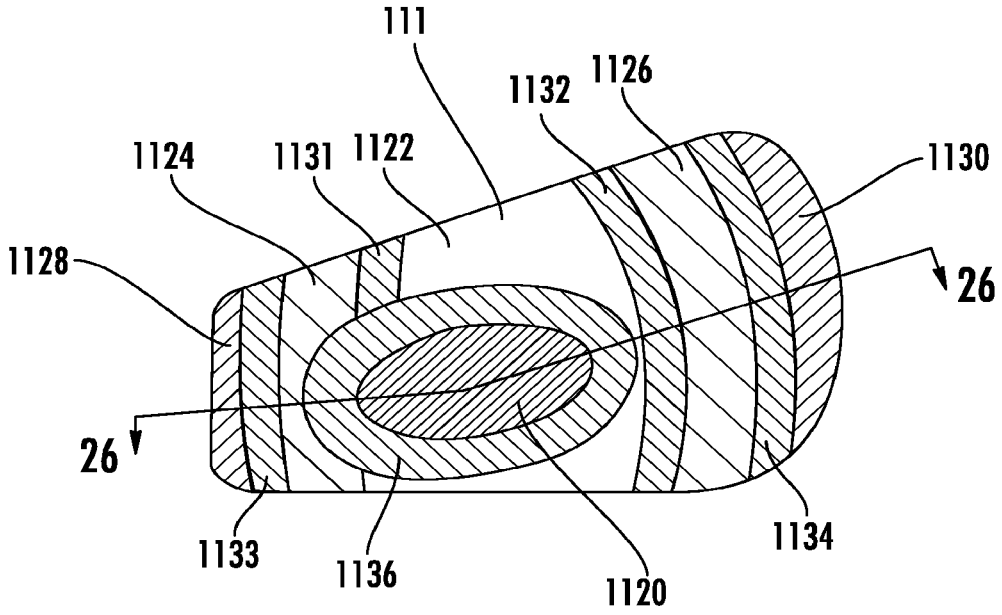
FIG. 25 is a rear view of an alternate embodiment of the face plate of the iron-type club head of FIG. 2, with the club head body removed for clarity.
Figure 26:
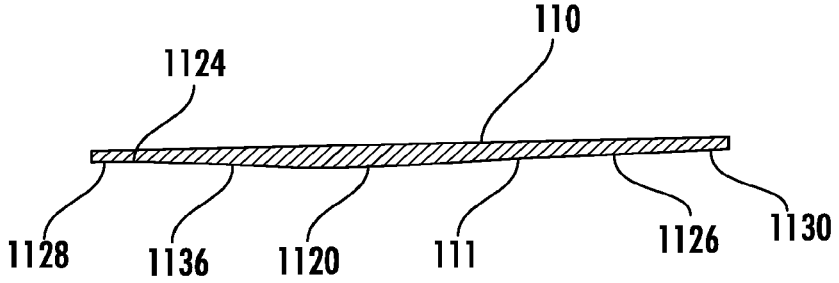
FIG. 26 is a cross-section of the face plate of FIG. 25, taken along line 26-26.

As an alternate embodiment of the face 110 of the club head 102. The alternate face 110 having multiple thickness regions as illustrated in FIGS. 25 and 26. FIG. 25 shows the rear surface 111 of the face 110 opposite the ball striking surface 109. The face 110 may have a plurality of regions having different thicknesses. For example, the plurality of regions may include a central region 1120 having a first thickness, a middle region 1122 having a second thickness, a mid-heel region 1124 having a third thickness, a mid-toe region 1126 having a fourth thickness, a heel region 1128 having a fifth thickness, and a toe region 1130 having a sixth thickness. The central region 1120 may have a thickness that is greater than the thickness of the other regions. The middle region 1122 may have a thickness that is less than the central region 1120, but greater than the thicknesses of the mid-heel region 1124, the mid-toe region 1126, the heel region 1128 and the toe region 1130. The mid-heel region 1124 and the mid-toe region 1126 may have the same thickness, or alternatively, the mid-heel region 1126 and the mid-toe region 1128 may have different thicknesses. The heel region 1128 and the toe region 1130 may have the same thickness, or alternatively, the heel region 1128 and the toe region 1130 may have different thicknesses.

The central region 1120 may be located near the face center location 140. The central region 1120 may have a generally oval shape with a major axis and a minor axis, wherein the major axis may be oriented in a direction from a low heel side to an upper toe side. The central region 1120 may have a thickness of approximately 2.7 mm, or within a range of 2.6 mm to 2.8 mm, or within a range of 2.5 mm to 2.9 mm. The middle region 1122 may be positioned from a top 1132 edge of the face plate 110 to a bottom edge 1134 of the face plate 110 shaping around at least a portion of central region 1102. The middle region 1122 may have a thickness of approximately 2.2 mm, or within a range of 2.1 mm to 2.3 mm, or within a range of 2.0 mm to 2.4 mm. The mid-heel region 1124 may be positioned between the middle region 1122 and the heel region 1128 proximate the heel side 116 of the face plate 110. The mid-heel region 1124 may have a thickness of approximately 1.9 mm, or within a range of 1.8 mm to 2.0 mm, or within a range of 1.7 mm to 2.1 mm. The mid-toe region 1126 may be positioned between the middle region 1122 and the toe region 1130 proximate the toe side 117 of the face plate 110. The mid-toe region 1126 may have a thickness of approximately 1.9 mm, or within a range of 1.8 mm to 2.0 mm, or within a range of 1.7 mm to 2.1 mm.

The heel region 1128 may be proximate the heel side 116 of the face plate 110. The heel region 1128 may have a thickness of approximately 1.6 mm, or within a range of 1.5 mm to 1.7 mm, or within a range of 1.4 mm to 1.8 mm. The toe region 1130 may be proximate the toe side 117 of the face plate 110. The toe region 1130 may have a thickness of approximately 1.6 mm, or within a range of 1.5 mm to 1.7 mm, or within a range of 1.4 mm to 1.8 mm. Optionally, the relative thicknesses of the regions may be expressed as a ratio such that the ratio of the thickness of the central region 1120 compared to either the thickness of either the heel region 1128 or the thickness of the toe region 1130 may be within a range of 1.85:1 and 1.55:1. Similarly, the ratio of the thickness of the central region 1120 compared to either the thickness of either the mid-heel region 1124 or the thickness of the mid-toe region 1126 may be within a range of 1.55:1 and 1.3:1.

Additionally, a plurality transition zones are positioned between the regions where the thickness ramps linearly, or smoothly, from one region to the other. For example, there are mid-transition zones 1131, 1132 between the middle region 1104 and the mid-heel and mid-toe regions 1124, 1126. End-transition zone 1133 is located between the mid-heel region 1124 and the heel region 1128, and end-transition zone 1134 is located between the mid-toe region 1126 and the toe region 1130. A central transition zone 1136 may be positioned between the central region 1102 and the middle region 1104 and the heel region 1128.

As discussed previously, the face 110 and the elongated channel 180 may work together to improve the responsiveness of the club head 102 during impact with a golf ball. The relationships between the face thicknesses and the corresponding parameters of the elongated channel 180 taken at cross-sections taken at a plane parallel to face center plane 144, where the face thickness may be measured at center face height, CFZ 145. These parameters may be best expressed as ratios as shown in Table 3.

For example, the parameters may be expressed as ratios taken from a cross-section at the face center plane 144. A ratio of the center of face thickness to the elongated channel 180 thickness, T1, may be approximately 2.08:1, or within a range of 1.86:1 to 2.33:1. Additionally, a ratio of the center of face thickness to the transition surface 183 thickness, T2, may be approximately 1.29:1, or within a range of 1.18:1 to 1.40:1. A ratio of the center of face thickness to the width, W1, of the elongated channel 180 may be approximately 0.77:1, or within a range of 0.72:1 to 0.82:1. Lastly, a ratio of the center of face thickness to the depth, D, of the elongated channel 180 may be approximately 0.54:1, or within a range of 0.43:1 to 0.70:1, or within a range of 0.37:1 to 0.93:1.

The parameters may be expressed as ratios taken at a cross-section 25.4 mm towards the toe from the face center plane 144. A ratio of the face thickness at 25.4 mm towards the toe from the face center plane 144 to the elongated channel 180 thickness, T1, may be approximately 1.46:1, or within a range of 1.29:1 to 1.67:1. Additionally, a ratio of the face thickness at 25.4 mm towards the toe from the face center plane 144 to the transition surface 183 thickness, T2, may be approximately 0.90:1, or within a range of 0.82:1 to 1.00:1. A ratio of the face thickness at 25.4 mm towards the toe from the face center plane 144 to the width, W1, of the elongated channel 180 may be approximately 0.54:1, or within a range of 0.50:1 to 0.59:1. Lastly, a ratio of the face thickness at 25.4 mm towards the toe from the face center plane 144 to the depth, D, of the elongated channel 180 may be approximately 0.38:1, or within a range of 0.30:1 to 0.50:1 or within a range of 0.26:1 to 0.67:1.

The parameters may be expressed as ratios taken at a cross-section 38.1 mm towards the toe from the face center plane 144. A ratio of the face thickness at 38.1 mm towards the toe from the face center plane 144 to the elongated channel 180 thickness, T1, may be approximately 1.23:1, or within a range of 1:07:1 to 1.42:1. Additionally, a ratio of the face thickness at 38.1 mm towards the toe from the face center plane 144 to the transition surface 183 thickness, T2, may be approximately 0.76:1, or within a range of 0.68:1 to 0.85:1. A ratio of the face thickness at 38.1 mm towards the toe from the face center plane 144 to the width, W1, of the elongated channel 180 may be approximately 0.46:1, or within a range of 0.42:1 to 0.50:1. Lastly, a ratio of the face thickness at 38.1 mm towards the toe from the face center plane 144 to the depth, D, of the elongated channel 180 may be approximately 0.32:1, or within a range of 0.25:1 to 0.43:1 or within a range of 0.21:1 to 0.57:1.

TABLE 3

Ratios of Face Thickness and Elongated Channel Parameters

| Description | Approx. Ratio | Ratio Range |
|---|---|---|
| Center of Face Thickness/Elongated Channel Thickness | 2.08:1 | 1.86:1 to 2.33:1 |
| Center of Face Thickness/Transition Surface Thk. | 1.29:1 | 1.18:1 to 1.40:1 |
| Center of Face Thickness/Elongated Channel Width | 0.77:1 | 0.72:1 to 0.82:1 |
| Center of Face Thickness/Elongated Channel Depth | 0.54:1 | .43:1 to .70:1 or .37:1 to .93:1 |
| Face Thickness (@25.4 mm towards Toe Side 117 from Center Face Location 140)/Elongated Channel Thickness | 1.46:1 | 1.29:1 to 1.67:1 |
| Face Thickness (@25.4 mm towards Toe Side 117 from Center Face Location 140)/Transition Surface Thk. | 0.90:1 | 0.82:1 to 1.00:1 |
| Face Thickness (@25.4 mm towards Toe Side 117 from Center Face Location 140)/Elongated Channel Width | 0.54:1 | '0.50:1 to 0.59:1 |
| Face Thickness (@25.4 mm towards Toe Side 117 from Center Face Location 140)/Elongated Channel Depth | 0.38:1 | 0.30:1 to 0.50:1 or 0.26:1 to 0.67:1 |
| Face Thickness (@38.1 mm towards Toe Side 117 from Center Face Location 140)/Elongated Channel Thickness | 1.23:1 | 1:07:1 to 1.42:1 |
| Face Thickness (@38.1 mm towards Toe Side 117 from Center Face Location 140)/Transition Surface Thk. | 0.76:1 | 0.68:1 to 0.85:1 |
| Face Thickness (@38.1 mm towards Toe Side 117 from Center Face Location 140) Elongated Channel Width | 0.46:1 | 0.42:1 to 0.50:1 |
| Face Thickness (@38.1 mm towards Toe Side 117 from Center Face Location 140)/Elongated Channel Depth | 0.32:1 | 0.25:1 to 0.43:1 or 0.21:1 to 0.57:1 |

Several different embodiments have been described above, including the iron-type golf club heads 102, 202, and 302, along with face geometries shown in FIGS. 23-26. It is understood that any of the features of these various embodiments may be combined and/or interchanged. For example, as described above, various different combinations of club heads 102, et seq. with differently configured elongated channels 180, et seq. or constructions may be used, including the configurations described herein, variations or combinations of such configurations, or other configurations. In further embodiments, at least some of the features described herein can be used in connection with other configurations of iron-type clubs, or with other non-iron-type clubs.

Club head 102, et seq. incorporating the features disclosed herein may be used as a ball striking device or a part thereof. For example, a golf club 100 as shown in FIG. 1 may be manufactured by attaching a shaft or handle 104 to a head that is provided, such as the club head 102 as described above. "Providing" the head, as used herein, refers broadly to making an article available or accessible for future actions to be performed on the article, and does not connote that the party providing the article has manufactured, produced, or supplied the article or that the party providing the article has ownership or control of the article. Manufacturing the club head 102, et seq. may also include forming one or more elongated channels 180, et seq. in the head. The elongated channel(s) 180, et seq. can be formed in one of many different manners, including being formed along with the club head 102, et seq. or body 108, et seq., or face member 310, et seq. such as in a casting/molding or forging process, or being formed in a post-manufacture process, such as cutting, milling, machining, etc. In other embodiments, different types of ball striking devices can be manufactured according to the principles described herein. Additionally, the club head 102, et seq., golf club 100, et seq., or other ball striking device may be fitted or customized for a person by custom fitting, which may include choosing a club head 102, et seq. having an elongated channel 180, et seq. with one or more particular characteristics that are suited for a particular golfer, or forming such an elongated channel 180, et seq. in the club head 102, et seq. Various other different configurations are possible, and various other club heads may be designed for various performance characteristics.

The ball striking devices and club heads therefor as described herein provide many benefits and advantages over existing products. For example, as described above, the flexing of the sole surface 114 and toe surface 118 at the elongated channel 180 can create a higher ball speed for impacts, particularly on those away from the center of the face. Further benefits and advantages are readily recognizable to those skilled in the art.

While the disclosure has been described with respect to specific examples including presently preferred modes of carrying out the disclosure, those skilled in the art will appreciate that there are numerous variations and permutations of the above described systems and methods. Thus, the spirit and scope of the disclosure should be construed broadly as set forth in the appended claims.

What is claimed is:

1. An iron-type golf club head, comprising:

a face comprising a substantially flat ball striking surface with a plurality of grooves, a rear surface opposite the ball striking surface, a body comprising a hosel, a heel side, a toe side, a toe surface, a top surface, and a sole surface, wherein the toe surface connects the top surface to the sole surface, and an elongated channel located in the sole surface being spaced backward from a leading edge, the elongated channel being recessed from the sole surface, wherein the elongated channel has a depth of recession from the sole surface and has a length defined between a first end located on the heel side of the sole surface and extending toward the toe side to a second end, wherein the first end of the elongate channel is located on the sole surface and the second end of the elongate channel is located on the toe surface, wherein the second end of the channel comprises a channel toe height defined by a distance from a ground plane, wherein the elongated channel has a forward wall and a rear wall, wherein an acute angle is formed between the forward wall and the rear wall, wherein a plurality of weighting elements are positioned on the sole surface and the toe surface, and wherein the plurality of weighting elements are separate from and positioned rearward of the elongated channel, and wherein the plurality of weighting elements comprise threading and are removable.

2. The iron-type golf club head of claim 1, wherein the second end of the elongated channel is located on the toe surface, and wherein the second end of the elongated channel is located within a range of 40 percent to 70 percent of a maximum club head height.

3. The iron-type golf club head of claim 1, wherein the elongated channel is generally parallel to the leading edge of the face.

4. The iron-type golf club head of claim 1, wherein the acute angle formed between the forward wall and the rear wall ranges between 0 and 20 degrees.

5. The iron-type golf club head of claim 1, wherein the acute angle formed between the forward wall and the rear wall ranges between 0 and 10 degrees.

6. The iron-type golf club head of claim 1, wherein at least one of the plurality of weighting elements is oriented along an axis substantially perpendicular to the toe surface.

7. The iron-type golf club head of claim 1, wherein the plurality of weighting elements comprises at least one weighting element positioned on the toe surface, at least one weighting element positioned near a center of the sole surface, and at least one weighting element positioned near the heel side of the sole surface.

8. The iron-type golf club head of claim 1, wherein the plurality of weighting elements comprises a first weighting element made of a first material and a second weighting element made of a second material.

9. The iron-type golf club head of claim 1, further comprising an overall sole thickness within a range between 13 mm and 31 mm.

10. An iron-type golf club head, comprising:

a face comprising a substantially flat ball striking surface with a plurality of grooves, a body comprising a hosel, a heel side, a toe side, a toe surface, a top surface, and a sole surface, and an elongated channel, wherein the elongated channel is located on the sole surface and the toe surface and spaced backward from a leading edge, the elongated channel being recessed from the sole surface and the toe surface, wherein the elongated channel has a depth of recession from the sole surface and the toe surface, and a length defined between a first end located in the heel side and a second end located on the toe surface, wherein the elongated channel has a forward wall and a rear wall, wherein an acute angle is formed between the forward wall and the rear wall, wherein a plurality of weighting elements are positioned on the sole surface and the toe surface with at least one of the plurality of weighting elements oriented along an axis substantially perpendicular to the sole surface, wherein the plurality of weighting elements comprise threading and are removable, wherein the iron-type golf club contains a hollow interior and wherein the plurality of weighting elements are separate from and positioned rearward of the elongated channel.

11. The iron-type golf club head of claim 10, wherein the iron-type golf club head has an overall sole thickness within a range between 13 mm and 31 mm.

12. The iron-type golf club head of claim 10, wherein at least one of the plurality of weighting elements is oriented along an axis substantially perpendicular to the toe surface.

13. The iron-type golf club head of claim 10, wherein the plurality of weighting elements comprises a first weighting element made of a first material and a second weighting element made of a second material.

14. The iron-type golf club head of claim 13, wherein the plurality of weighting elements further comprises a third weighting element wherein the first weighting element, the second weighting element, and the third weighting element are cylindrically shaped and have the same volume.

15. An iron-type golf club head, comprising:

a face comprising a substantially flat ball striking surface with a plurality of grooves, a body comprising a hosel, a heel side, a toe side, a toe surface, a top surface, and a sole surface, a rear body member enclosing a hollow interior, an elongated channel located on the sole surface and the toe surface and being spaced backward from a leading edge, the elongated channel being recessed from the sole surface and the toe surface, a first weighting element, a second weighting element, and a third weighting element, wherein the elongated channel has a depth of recession from the sole surface and the toe surface and a length defined between a first end located in the heel side and a second end located on the toe surface, wherein the elongated channel has a forward wall and a rear wall, wherein an acute angle is formed between the forward wall and the rear wall wherein the first weighting element, the second weighting element, and the third weighting element comprise threading and are removable, wherein the iron-type golf club head has an overall sole thickness within a range between 13 mm and 31 mm, and wherein the plurality of weighting elements are separate from and positioned rearward of the elongated channel.

16. The iron-type golf club head of claim 15, wherein the first weighting element has a first axis oriented substantially perpendicular to the toe surface, the second weighting element has a second axis oriented substantially perpendicular to the sole surface, and the third weighting element has a third axis oriented substantially perpendicular to the sole surface.

17. The iron-type golf club head of claim 15, wherein the first weighting element is made of a first material and the second weighting element is made of a second material, and wherein the first material is different than the second material.

18. The iron-type golf club head of claim 15, wherein the second end of the elongated channel is located within a range of 40 percent to 70 percent of a maximum club head height.

19. The iron-type golf club head of claim 15, wherein the first weighting element, the second weighting element, and the third weighting element are cylindrically shaped and have the same volume.

20. The iron-type golf club head of claim 15, wherein the rear body member is made of a carbon fiber reinforced polymer.

* * * * *